US005534403A

United States Patent [19]

Nishigaki et al.

[11] Patent Number: 5,534,403

[45] **Date of Patent: *Jul. 9, 1996**

[54] SILVER HALIDE PHOTOGRAPHIC MATERIAL

[75] Inventors: Junji Nishigaki; Takashi Kato, both of Kanagawa, Japan

[73] Assignee: Fuji Photo Film Co., Ltd., Kanagawa, Japan

[ * ] Notice: The term of this patent shall not extend beyond the expiration date of Pat. No. 5,439,789.

[21] Appl. No.: 228,200

[22] Filed: Apr. 15, 1994

[30] Foreign Application Priority Data

Apr. 16, 1993 [JP] Japan ..... 5-112504

[51] Int. Cl.[6] ..... G03C 1/18

[52] U.S. Cl. ..... 430/585; 430/588

[58] Field of Search ..... 430/585, 588

[56] References Cited

U.S. PATENT DOCUMENTS

| | | | |
|---|---|---|---|
| 4,172,730 | 10/1979 | Hinata et al. | 430/588 |
| 4,970,141 | 11/1990 | Ikegawa et al. | 430/585 |
| 5,238,806 | 8/1993 | Hashi | 430/588 |
| 5,290,655 | 3/1994 | Iwasaki | 430/588 |
| 5,439,789 | 8/1995 | Kato et al. | 430/581 |

FOREIGN PATENT DOCUMENTS 675654 7/1952 United Kingdom .

*Primary Examiner*—Thorl Chea

*Attorney, Agent, or Firm*—Sughrue, Mion, Zinn, Macpeak & Seas

[57] ABSTRACT

A silver halide photographic material comprising at least one compound represented by the following formula (I) or formula (II):

(I)

(II)

wherein $R_{11}$, $R_{12}$, $R_{21}$ and $R_{22}$ each represents a substituted or unsubstituted alkyl group; $R_{13}$ and $R_{23}$ each represents a hydrogen atom, a substituted or unsubstituted alkyl group or a substituted or unsubstituted aryl group; $V_1$, $V_2$, $V_3$, $V_4$, $V_5$, $V_6$, $V_7$, $V_8$, $V_9$, $V_{10}$, $V_{11}$, $V_{4A}$, $V_{5A}$, $V_{6A}$, $W_{01}$ and $W_{02}$ each represents a hydrogen atom or a substituent, wherein at least one of $V_7$ and $V_{11}$ is a substituent; $W_{21}$ represents a substituent having two or more carbon atoms; $X_1$ and $X_2$ each represents a charge-neutralizing counter ion; and m and n each represents a number of 0 or more necessary for neutralizing the molecular charge.

18 Claims, No Drawings

SILVER HALIDE PHOTOGRAPHIC MATERIAL

FIELD OF THE INVENTION

This invention relates to a silver halide photographic material, and more particularly to a silver halide photographic material containing a silver halide photographic emulsion which has increased spectral sensitivity in the short wavelength region of green light and is excellent in storage stability.

BACKGROUND OF THE INVENTION

It is demanded to develop a method which can increase spectral sensitivity in the short wavelength region of green light and can improve the color reproducibility of photographic materials in the field of silver halide color photographic materials.

Conventional methods for increasing spectral sensitivity in the wavelength region of green light include the applications of photographic emulsions containing a combination of oxacarbocyanine and benzimidazolocarbocyanine (described in JP-A-59-116646 (the term "JP-A" as used herein means an "unexamined published Japanese patent application"), JP-A-59-116647, JP-A-59-140443 and JP-A-59-149346), a combination of oxacarbocyanine and oxathiacarbocyanine (described in JP-B-46-11627 (the term "JP-B" as used herein means an "examined Japanese patent publication"), and JP-A-60- 42750) and a combination of two or more oxacarbocyanines (described in JP-A-52-23931). However, spectral sensitivity in the short wavelength region of green light at 520 to 545 nm is low, and in any of these methods, it has been inconvenient to color reproducibility. Accordingly, it has been considered that sensitizing dyes having the maximum spectral sensitivity at 520 to 545 nm are further used in combination. Benzimidazolooxazolocarbocyanine (described in JP-B-44-14030) and dimethinemerocyanine (described in U.S. Pat. Nos. 2,493,743, 2,519,001 and 3,480,439) are conventionally known as sensitizing dyes having the maximum spectral sensitivity at 520 to 545 nm. However, since emulsions containing benzimidazolooxazolocarbocyanine or dimethinemerocyanine have disadvantages in that fog is increased under high temperature conditions or under high temperature and humidity conditions after the coating of the emulsions, and sensitivity is lowered because of poor long-term stability after the coating of the emulsions, it has been thought that the combination thereof are not suitable.

There are known oxacarbocyanines, which have less inconvenience, having the maximum spectral sensitivity at 520 to 545 nm alone. Examples of the oxacarbocyanines are described in U.S. Pat. Nos. 2,521,705 and 2,521,959, 2,647,054 and JP-A-63-167348. However, the spectral sensitivity of these dyes has been still insufficient. Further, the sensitizing dyes represented by formulae (I) and (II) for use in the present invention have a substituent at a 5-phenyl group of a benzoxazole nucleus constituting the dyes. On the other hand, the dyes having a substituted phenyl group are disclosed in British Patents 1,031,483, 675,654 and U.S. Pat. No. 2,592,243. However, the substituents and substituted positions thereof are extremely limited, and they have been very insufficient to photographic properties.

Monomethinecyanines having 2-quinoline skeleton have the maximum spectral sensitivity at 520 to 545 nm. However, when they alone are used, sensitivity is low, and hence they are used in combination with benzimidazolocarbocyanine or oxacarbocyanine (described in JP-B- 56-24939, JP-B-56-38936, JP-B-56-38940 and U.K. Patent 1,219,016). When these combinations are used, the region of spectral sensitivity is shifted to a longer wavelength side, and hence good color reproducibility cannot be obtained. Accordingly, it has been demanded to develop a method which can increase spectral sensitivity in the short wavelength region of green light to obtain the true color reproducibility of color photographic materials.

SUMMARY OF THE INVENTION

An object of the present invention is to provide a color photographic material which has increased spectral sensitivity in the short wavelength region of green light and is excellent in long-term stability.

This and other objects of the present invention have been achieved by providing a silver halide photographic material comprising a support and having thereon at least one silver halide photographic emulsion layer and containing at least one compound represented by the following formula (I) or formula (II):

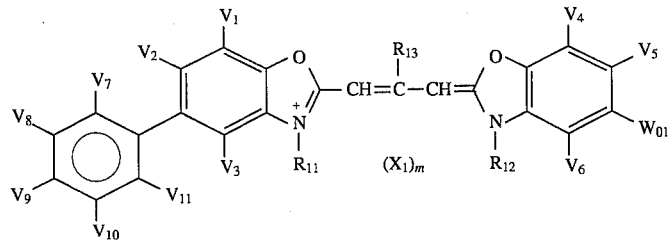

(I)

wherein $R_{11}$ and $R_{12}$ are the same or different and each represents a substituted or unsubstituted alkyl group; $R_{13}$ represents a hydrogen atom, a substituted or unsubstituted alkyl group or a substituted or unsubstituted aryl group; $V_1$, $V_2$, $V_3$, $V_4$, $V_5$, $V_6$, $V_7$, $V_8$, $V_9$, $V_{10}$, $V_{11}$ and $W_{01}$ are the same or different and each represents a hydrogen atom or a substituent, wherein at least one of $V_7$ and $V_{11}$ is a substituent; $X_1$ represents a charge-neutralizing counter ion; and m represents a number of 0 or more necessary for neutralizing the molecular charge;

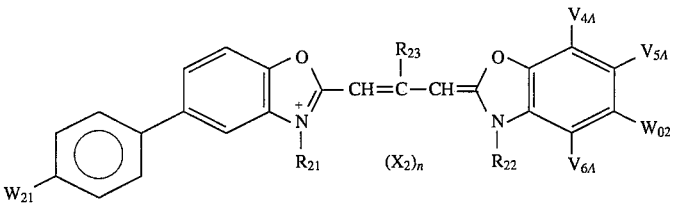

(II)

wherein $R_{21}$, $R_{22}$, $R_{23}$, $X_2$ and n have the same meaning as $R_{11}$, $R_{12}$, $R_{13}$, $X_1$ and m in formula (I), respectively; $V_{4A}$, $V_{5A}$, $V_{6A}$ and $W_{02}$ are the same or different and each represents a hydrogen atom or a substituent; and $W_{21}$ represents a substituent having 2 or more carbon atoms.

DETAILED DESCRIPTION OF THE INVENTION

Of the sensitizing dyes represented by formula (I), compounds represented by the following formula (III) are preferred:

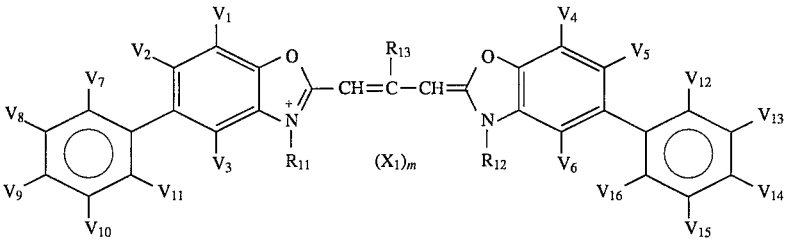

(III)

wherein $R_{11}$ and $R_{12}$ are the same or different and each represents a substituted or unsubstituted alkyl group; $R_{13}$ represents a hydrogen atom, a substituted or unsubstituted alkyl group or a substituted or unsubstituted aryl group; $V_1$, $V_2$, $V_3$, $V_4$, $V_5$, $V_6$, $V_7$, $V_8$, $V_9$, $V_{10}$, $V_{11}$, $V_{12}$, $V_{13}$, $V_{14}$, $V_{15}$ and $V_{16}$ are the same or different and each represents a hydrogen atom or a substituent, wherein at least one of $V_7$ and $V_{11}$ is a substituent; $X_1$ represents a charge-neutralizing counter ion; and m represents a number of 0 or more necessary for neutralizing the molecular charge.

Of the sensitizing dyes represented by formula (II), compounds represented by the following formula (IV) are preferred:

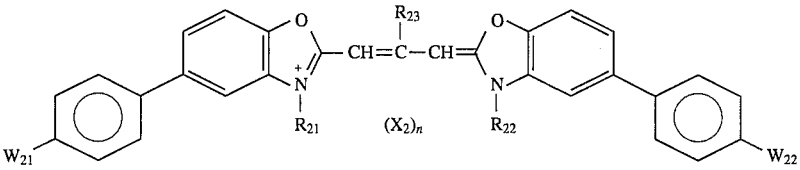

(IV)

wherein $R_{21}$, $R_{22}$, $R_{23}$, $X_2$ and n have the same meaning as $R_{11}$, $R_{12}$, $R_{13}$, $X_1$ and m in formula (I), respectively; $W_{22}$ represents a substituent; and $W_{21}$ represents a substituent having 2 or more carbon atoms.

In these formulae, the alkyl groups represented by $R_{11}$ and $R_{12}$ may be substituted. Specific examples of the alkyl groups include an alkyl group having from 1 to 8 carbon atoms (e.g., methyl, ethyl, n-propyl, iso-propyl, n-butyl, n-pentyl, n-hexyl, n-octyl); an aralkyl group having from 7 to 10 carbon atoms (e.g., benzyl, phenetyl, 3-phenylpropyl); and an alkyl group having from 1 to 6 carbon atoms substituted by one or more of a hydroxyl group, a carboxyl group, a sulfo group, a cyano group, a halogen atom (e.g., fluorine, chlorine, bromine, iodine ), an alkoxycarbonyl group having from 2 to 8 carbon atoms (e.g., methoxycarbonyl, ethoxycarbonyl, benzyloxycarbonyl), an alkoxy group having from 1 to 8 carbon atoms (e.g., methoxy, ethoxy, propoxy, butyloxy, benzyloxy, phenethyloxy), an aryloxy group having from 6 to 8 carbon atoms (e.g., phenoxy, p-tolyloxy), an acyloxy group having from 1 to 8 carbon atoms (e.g., acetyloxy, propionyloxy, benzoyloxy), an acyl group having from 1 to 8 carbon atoms (e.g., acetyl, propionyl, benzoyl, 4-fluorobenzoyl), a carbamoyl group having from 1 to 6 carbon atoms (e.g., carbamoyl, N,N-dimethylcarbamoyl, morpholinocarbonyl, piperidinocarbonyl), a sulfamoyl group having from 0 to 6 carbon atoms (e.g., sulfamoyl, N,N-dimethylsulfamoyl, morpholinosulfonyl, piperidinosulfonyl) and an aryl group having from 6 to 10 carbon atoms (e.g., phenyl, p-fluorophenyl, p-carboxyphenyl, p-hydroxyphenyl, p-sulfophenyl).

As the alkyl group represented by $R_{11}$ and $R_{12}$, a sulfoethyl group, a sulfopropyl group, a sulfobutyl group, a carboxymethyl group and a carboxyethyl group are preferred. Among these, a sulfoethyl group and a sulfobutyl group are more preferred.

$R_{13}$ represents a hydrogen atom; a substituted or unsubstituted alkyl group having from 1 to 5 carbon atoms (e.g., methyl, ethyl, propyl, butyl, hydroxyethyl, trifluoromethyl, 2-chloroethyl, chloromethyl, methoxymethyl, 2-methoxyethyl, benzyl); or an unsubstituted aryl group having from 6 to 10 carbon atoms or a substituted aryl group having from 6 to 15 carbon atoms (e.g., phenyl, o-carboxyphenyl, p-tolyl, m-tolyl). $R_{13}$ is preferably a hydrogen atom or an unsubstituted alkyl group, and more preferably a methyl group, an ethyl group or a propyl group.

Examples of the substituents represented by $V_1$, $V_2$, $V_3$, $V_4$, $V_5$, $V_6$, $V_7$, $V_8$, $V_9$, $V_{10}$, $V_{11}$, $V_{12}$, $V_{13}$, $V_{14}$, $V_{15}$, $V_{16}$, $V_{4A}$, $V_{5A}$, $V_{6A}$, $W_{01}$ and $W_{02}$ include a hydrogen atom, a substituted or unsubstituted alkyl group having from 1 to 7 carbon atoms (e.g., methyl, ethyl, propyl, butyl, hydroxyethyl, trifluoromethyl, benzyl, sulfopropyl, diethylaminoethyl, cyanopropyl, adamantyl, p-chlorophenethyl, ethoxyethyl, ethylthioethyl, phenoxyethyl, carbamoylethyl, carboxyethyl, ethoxycarbonylmethyl, acetylaminoethyl), a substituted or unsubstituted alkenyl group having from 3 to 10 carbon atoms (e.g., allyl, styryl), a substituted or unsubstituted aryl group having from 6 to 10 carbon atoms (e.g., phenyl, naphthyl, p-carboxyphenyl, 3,5-dicarboxyphenyl, m-sulfophenyl, p-acetamidophenyl, 3-caprylamidophenyl, p-sulfamoylphenyl, m-hydroxyphenyl, p-nitrophenyl, 3,5-dichlorophenyl, p-anisyl, o-anisyl, p-cyanophenyl, p-N-methylureidophenyl, m-fluorophenyl, p-tolyl, m-tolyl), a substituted or unsubstituted heterocyclic group having from 1 to 10 carbon atoms (e.g., pyridyl, 5-methyl-2-pyridyl, thienyl), halogen atom (e.g., chlorine, bromine, fluorine), mercapto group, a cyano group, a carboxyl group, a sulfo group, a hydroxyl group, a carbamoyl group, a sulfamoyl group, an amino group, a nitro group, a substituted or unsubstituted alkoxy group having from 1 to 10 carbon atoms (e.g., methoxy, ethoxy, 2-methoxyethoxy, 2-phenylethoxy), a substituted or unsubstituted aryloxy group having from 6 to 10 carbon atoms (e.g., phenoxy, p-methylphenoxy, p-chlorophenoxy), a substituted or unsubstituted acyl group having from 2 to 7 carbon atoms (e.g., acetyl, benzoyl), a substituted or unsubstituted acylamino group having from 2 to 7 carbon atoms (e.g., acetylamino, caproylamino), a substituted or unsubstituted sulfonyl group (e.g., methanesulfonyl, benzenesulfonyl), a substituted or unsubstituted sulfonylamino group (e.g., methanesulfonylamino, benzenesulfonylamino), a substituted amino group (e.g., diethylamino, hydroxyamino), a substituted or unsubstituted alkylthio or arylthio group having from 1 to 7 carbon atoms (e.g., methylthio, carboxyethylthio, sulfobutylthio, phenylthio), a substituted or unsubstituted alkoxycarbonyl group having from 2 to 10 carbon atoms (e.g., methoxycarbonyl) or a substituted or unsubstituted aryloxycarbonyl group having from 7 to 11 carbon atoms (e.g., phenoxycarbonyl).

These substituents may be further substituted by one or more of an alkyl group, an alkenyl group, an aryl group, a hydroxyl group, a carboxyl group, a sulfo group, a nitro group, a cyano group, a halogen atom, an alkoxy group, an aryloxy group, an alkoxycarbonyl group, an acyl group, an acylamino group, a sulfonamino group, a carbamoyl group and a sulfamoyl group.

As the substituents represented by $V_1$, $V_2$, $V_3$, $V_4$, $V_5$, $V_6$, $V_7$, $V_8$, $V_9$, $V_{10}$, $V_{11}$, $V_{12}$, $V_{13}$, $V_{14}$, $V_{15}$, $V_{16}$, $V_{4A}$, $V_{5A}$ and $V_{6A}$, a hydrogen atom, an alkyl group having from 1 to 5 carbon atoms, an alkoxy group having from 1 to 5 carbon atoms, an aryloxy group having from 6 to 10 carbon atoms, a halogen atom and a trifluoromethyl group are preferred. Among these, a hydrogen atom, a methyl group, an ethyl group, a propyl group, a methoxy group, an ethoxy group, a phenoxy group, a chlorine atom and a trifluoromethyl group are more preferred. $V_7$ is most preferably a methyl group, an ethyl group, a propyl group, a methoxy group, an ethoxy group, a phenoxy group, a chlorine atom or a trifluoromethyl group. $V_1$, $V_2$, $V_3$, $V_4$, $V_5$, $V_6$, $V_{4A}$, $V_{5A}$ and $V_{6A}$ are each most preferably a hydrogen atom.

$X_1$ represents a charge-neutralizing counter ion. Ion for neutralizing charge in the molecule is selected from anions and cations. Examples of the anions include inorganic and organic acid anions (e.g., p-toluenesulfonate, p-nitrobenzenesulfonate, methanesulfonate, methylsulfonate, ethylsulfonate, perchlorate) and a halogen ion (e.g., chloride, bromide, iodide). The cations include inorganic and organic cations. Specific examples of the cations include a hydrogen ion, an alkali metal ion (e.g., lithium, sodium, potassium and cesium ions), an alkaline earth metal ion (e.g., magnesium, calcium and strontium ions) and an ammonium ion (e.g., organic ammonium, triethanol ammonium and pyridium ions).

m is a number necessary for neutralizing the molecular charge, and when the compound forms an inner salt, m is 0.

In formulae (II) and (IV), $R_{21}$, $R_{22}$, $R_{23}$, $X_2$ and n have the same meaning as $R_{11}$, $R_{12}$, $R_{13}$, $X_1$ and m in formula (I), respectively.

$W_{21}$ and $W_{22}$ each represents a substituted or unsubstituted alkyl group having from 2 to 7 carbon atoms (e.g., ethyl, propyl, butyl, hydroxyethyl, benzyl, diethylaminoethyl, cyanopropyl, adamantyl, p-chlorophenethyl, ethoxyethyl, ethylthioethyl, phenoxyethyl, carbamoylethyl, carboxyethyl, ethoxycarbonylmethyl, acetylaminoethyl), a substituted or unsubstituted alkenyl group having from 3 to 10 carbon atoms (e.g., allyl, styryl), a substituted or unsubstituted aryl group having from 6 to 10 carbon atoms (e.g., phenyl, naphthyl, p-carboxyphenyl,3,5-dicarboxyphenyl, m-sulfophenyl, p-acetamidophenyl, 3-caprylamidophenyl, p-sulfamoylphenyl, m-hydroxyphenyl, p-nitrophenyl, 3,5-dichlorophenyl, p-anisyl, o-anisyl, p-cyanophenyl, p-N-methylureidophenyl, m-fluorophenyl, p-tolyl, m-tolyl), a substituted or unsubstituted heterocyclic group having from 2 to 10 carbon atoms (e.g., pyridyl, 5-methyl-2-pyridyl, thienyl), a substituted or unsubstituted alkoxy group having from 2 to 10 carbon atoms (e.g., ethoxy, 2-methoxyethoxy, 2-phenylethoxy), a substituted or unsubstituted aryloxy group having from 6 to 10 carbon atoms (e.g., phenoxy, p-methylphenoxy, p-chlorophenoxy), a substituted or unsubstituted acyl group having from 2 to 7 carbon atoms (e.g., acetyl, benzoyl), a substituted or unsubstituted alkylthio or arylthio group having from 2 to 7 carbon atoms (e.g., ethylthio, phenylthio), a substituted or unsubstituted alkoxycarbonyl group having from 2 to 10 carbon atoms (e.g., methoxycarbonyl) or a substituted or unsubstituted aryloxycarbonyl group having from 7 to 11 carbon atoms (e.g., phenoxycarbonyl).

As the substituents represented by $W_{21}$ and $W_{22}$, an alkyl group having 2 or more carbon atoms, an alkoxy group having 2 or more carbon atoms, an aryl group and an aryloxy group are preferred. Among these, a propyl group, a t-butyl group, an ethoxy group, an n-butyl group or a phenoxy group are more preferred.

Specific examples of the sensitizing dyes of formulae (I), (II), (III) and (IV) include, but are not limited to, the following compounds.

Me, Et, $^t$Am, $^n$Pr, $^n$Bu and $^t$Bu as used hereinafter mean a methyl group, an ethyl group, a tert-amyl group, a normal propyl group, a normal butyl group and a tert-butyl group, respectively.

Compounds represented by formulae (I) and (III):

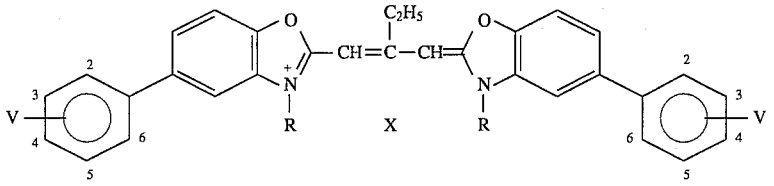

| No. | R | V | X |
|---|---|---|---|
| I-1 | $-(CH_2)_2SO_3^-$ | 2-Me | 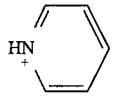 |
| I-2 | $-(CH_2)_2SO_3^-$ | 2-OMe | $Na^+$ |
| I-3 | $-(CH_2)_2SO_3^-$ | 2-$CF_3$ | $Li^+$ |
| I-4 | $-(CH_2)_4SO_3^-$ | 2-Me, 4-Me | 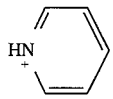 |
| I-5 | $-(CH_2)_4SO_3^-$ | 2-Me | $Na^+$ |
| I-6 | $-(CH_2)_4SO_3^-$ | 2-Me, 4-Et | " |
| I-7 | $-(CH_2)_4SO_3^-$ | 2-OMe | " |
| I-8 | $-(CH_2)_4SO_3^-$ | 2-OMe, 4-Et | " |
| I-9 | $-(CH_2)_3SO_3^-$ | 2-OEt | " |
| I-10 | $-CH_2COO^-$ | 2-$CF_3$ | $Na^+$ |
| I-11 | $-CH_2CH_2CH(SO_3^-)CH_3$ | 2-Me, 4-Me | $K^+$ |
| I-12 | " | 2-Me, 4-OMe | $Li^+$ |
| I-13 | " | 2-Me, 6-Me | $Na^+$ |
| I-14 | $-(CH_2)_3SO_3^-$ | 2-Me, 4-Me, 6-Me | $\overset{+}{H}N(C_2H_5)_3$ |
| I-15 | " | 2-F | " |
| I-16 | " | 2-Cl | " |
| I-17 | $-(CH_2)_4SO_3^-$ | 2-Cl, 4-Me | $Na^+$ |
| I-18 | $-(CH_2)_2OSO_3^-$ | 2-F, 6-F | " |
| I-19 | $-(CH_2)_2CONHSO_2CH_3$ | 2-Me, 4-Ph | $Br^-$ |
| I-20 | $-(CH_2)_2COO^-$ | 2-$O^nC_3H_7$ | $Na^+$ |

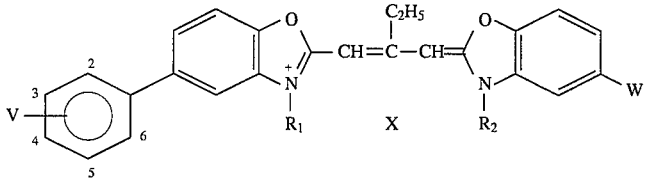

| No. | $R_1$ | $R_2$ | V | W | X |
|---|---|---|---|---|---|
| I-21 | $-(CH_2)_2SO_3^-$ | $-(CH_2)_2SO_3^-$ | 2-Me | 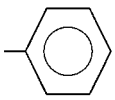 | $Na^+$ |
| I-22 | $-(CH_2)_3SO_3^-$ | $-(CH_2)_2SO_3^-$ | 2-OMe | " | $Na^+$ |
| I-23 | $-(CH_2)_4SO_3^-$ | $-(CH_2)_2SO_3^-$ | 2-$CF_3$ | $-Cl$ | $Na^+$ |

-continued
| | | | | | |
|---|---|---|---|---|---|
| I-24 | $-(CH_2)_4SO_3^-$ | $-(CH_2)_4SO_3^-$ | 2-OEt | " | $Na^+$ |
| I-25 | $-(CH_2)_4SO_3^-$ | $-(CH_2)_4SO_3^-$ | 2-Me, 4-OEt | " | $K^+$ |
| I-26 | $-(CH_2)_4SO_3^-$ | $-CH_2CH_2CH(SO_3^-)CH_3$ | 2-OMe, 4-Me | $^tA_m$ | $K^+$ |
| I-27 | $-(CH_2)_2SO_3^-$ | $-(CH_2)_2COO^-$ | 2-OEt, 4-Me | " | $Na^+$ |
| I-28 | $-(CH_2)_2COO^-$ | $-(CH_2)_2COO^-$ | 2-$CF_3$, 4-OEt | 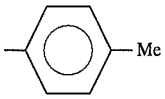 | $Na^+$ |
| I-29 | $-(CH_2)_2OSO_3^-$ | $-(CH_2)_2OH$ | 2-Cl | " | — |
| I-30 | $-(CH_2)_4SO_3^-$ | $-(CH_2)_2OH$ | 2-F | " | — |
(I-31)
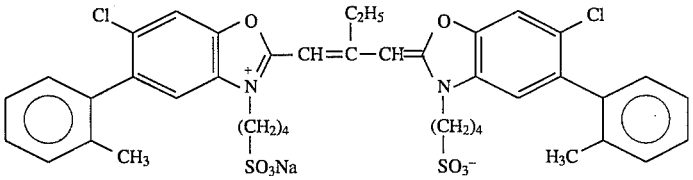
(I-32)
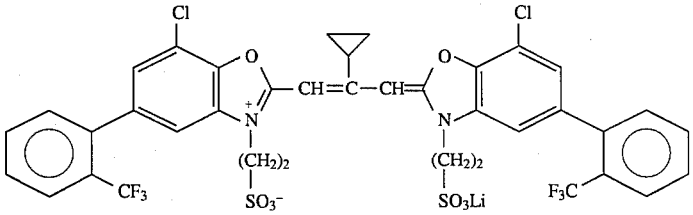
(I-33)
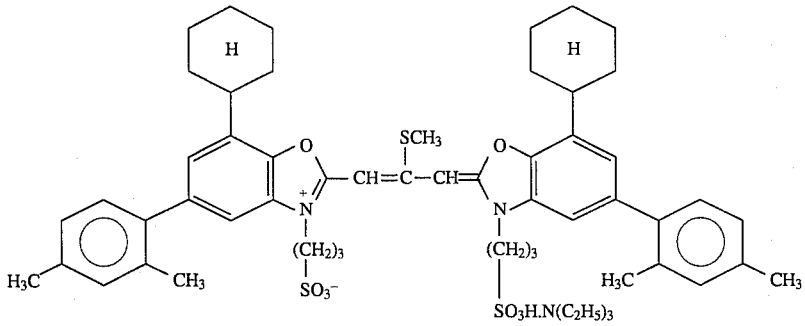
(I-34)
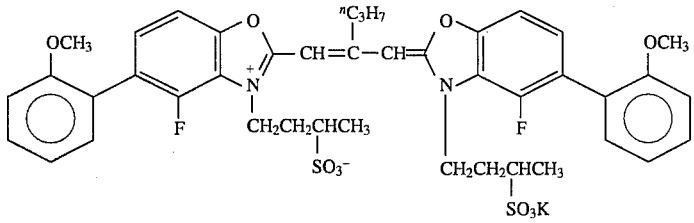
Compounds represented by formulae (II) and (IV):
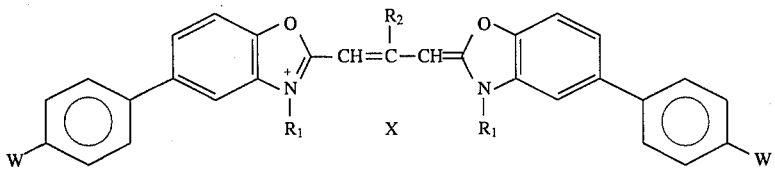
| No. | W | $R_1$ | $R_2$ | X |
|---|---|---|---|---|

-continued

| | | | | |
|---|---|---|---|---|
| II-1 | $-OEt$ | $+(CH_2)_4SO_3^-$ | Et | $Na^+$ |
| II-2 | $-O\ ^nPr$ | $+(CH_2)_2SO_3^-$ | Et | $\overset{+}{HN}$ |
| II-3 | $-O\ ^tBu$ | $+(CH_2)_3SO_3^-$ | $^nPr$ | $\overset{+}{HN}(C_2H_5)_3$ |
| II-4 | $^nPr$ | $+(CH_2)_2CH(SO_3^-)CH_3$ | Et | $Na^+$ |
| II-5 | $^nBu$ | $+(CH_2)_2COO^-$ | Me | — |
| II-6 | $^tBu$ | $+(CH_2)_3CH_3$ | Me | $I^-$ |
| II-7 | $-O-$ | $+(CH_2)_2CONHSO_2CH_3$ | Et | $Br^-$ |
| II-8 | $-SEt$ | $+(CH_2)_3SO_3^-$ | Et | $Li^+$ |
| II-9 | $-COCH_3$ | $+(CH_2)_3SO_3^-$ | Et | $K^+$ |
| II-10 | $-OCH_2-$ | $+(CH_2)_4SO_3^-$ | Et | $K^+$ |

| No. | $W_1$ | $W_2$ | $R_1$ | $R_2$ | $R_3$ | X |
|---|---|---|---|---|---|---|
| II-11 | $-OEt$ | $-H$ | $+(CH_2)_4SO_3^-$ | $+(CH_2)_2SO_3^-$ | Et | $Na^+$ |
| II-12 | $-O\ ^nPr$ | $-H$ | $+(CH_2)_3SO_3^-$ | $+(CH_2)_2SO_3^-$ | Et | $\overset{+}{HN}$ |
| II-13 | $^nPr$ | $-H$ | $+(CH_2)_3SO_3^-$ | $+(CH_2)_3SO_3^-$ | Et | $Na^+$ |
| II-14 | $^tBu$ | $-H$ | $+(CH_2)_2COO^-$ | $+(CH_2)_2COOH$ | Et | — |
| II-15 | $^nBu$ | $-H$ | $+(CH_2)_2CH(SO_3^-)CH_3$ | $+(CH_2)_2SO_3^-$ | Et | $Li^+$ |
| II-16 | $^tAm$ | $-H$ | $+(CH_2)_2SO_3^-$ | $+(CH_2)_2SO_3^-$ | Et | $\overset{+}{HN}(C_2H_5)_3$ |
| II-17 | $-O-$ | $-H$ | $+(CH_2)_4SO_3^-$ | $-C_2H_5$ | Et | — |
| II-18 | $-SEt$ | $-H$ | $+(CH_2)_4SO_3^-$ | $-CH_3$ | Et | — |
| II-19 | $-O-CH_2-$ | $-H$ | $+(CH_2)_2CONHSO_2CH_3$ | $+(CH_2)_2CONHSO_2CH_3$ | Et | $Br^-$ |

-continued

| | | | | |
|---|---|---|---|---|
| II-20 | 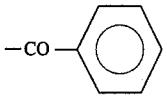 | −H | 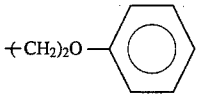 | −$CH_3$ | Et $I^-$ |

The compounds represented by formulae (I), (II), (III) and (IV) according to the present invention can be synthesized by the methods described in F. M. Hammer, *Heterocyclic Compounds-Cyanine Dyes and Related Compounds* (John Wiley and Sons, New York, London 1964), D. M. Sturmer, *Heterocyclic Compounds-Special Topics in Heterocyclic Chemistry,* Chapter 18, Paragraph 14, pp. 482–515 (John Wiley and Sons, New York, London 1977), *Rodd's Chemistry of Carbon Compounds,* (2nd. Ed. Vol. IV, part B 1977) Chapter 15, pp. 369–422, ibid., (2nd Ed. Vol. IV, part B 1985) Chapter 15, pp. 267–296 (Elsevier Science Publishing Company Inc. New York).

Synthesis example of Compound (I-5) according to the present invention will be illustrated below.

Scheme

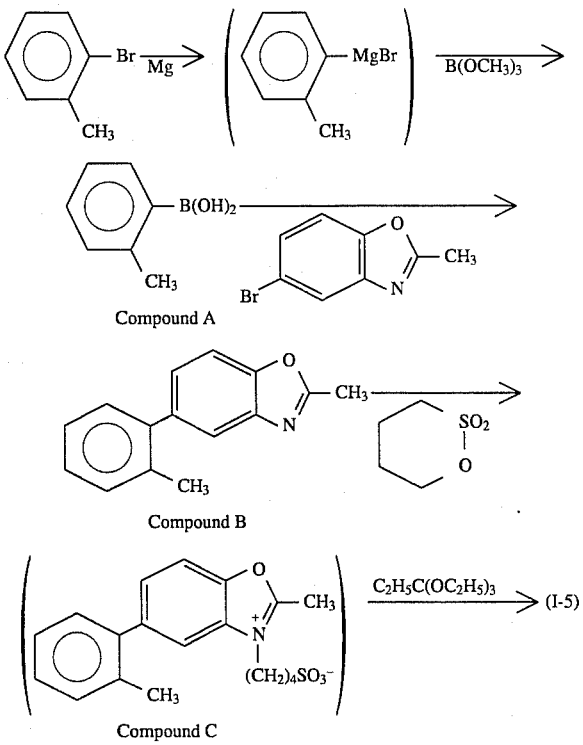

Synthesis of Compound A o-Bromotoluene (51.3 g, 0.3 mol) and magnesium (10.2 g) were reacted in 70 ml of tetrahydrofuran to prepare Grignard reagent. Trimethyl borate (31.2 g, 0.3 mol) and diethyl ether (150 ml) were charged into another container, and the temperature of the resulting solution was kept at −60° C. or below in a nitrogen gas atmosphere. The Grignard reagent was added dropwise to the solution over a period of 10 minutes. After the resulting mixture as such was stirred for 3 hours, 15 ml of water was added dropwise thereto. The temperature of the mixture was raised to room temperature, and 100 ml of an aqueous solution containing 8 ml of concentrated sulfuric acid was added dropwise thereto. The resulting mixture was stirred at room temperature for further one hour. The resulting reaction mixture (solution) was extracted with 500 ml of diethyl ether. The diethyl ether layer was concentrated under reduced pressure to obtain the crude crystal of compound A. The crude crystal was washed with hot hexane to obtain 24.5 g (yield: 60%) of Compound A.

Synthesis of Compound B

Compound A (4.1 g, 0.03 mol) and 5-bromo-2-methylbenzoxazole (4.2 g, 0.02 mol) were dissolved in dimethylformamide (65 ml). Tetrakistriphenyl phosphinepalladium (0.7 g, 0.6 mmol) and potassium carbonate (8.3 g, 0.06 mol) were added thereto. The temperature of the mixture was raised to 90° C., and the mixture as such was stirred for 8 hours. After completion of the reaction, the temperature of the reaction mixture was cooled to room temperature, and 20 ml of water was added thereto. The mixture was stirred for 10 minutes. The reaction mixture was extracted with methylene chloride. The organic layer was dried over magnesium sulfate, filtered and concentrated under reduced pressure. The resulting residue was purified by means of silica gel column to obtain Compound B (4.1 g, yield: 92%) as an oily product.

Synthesis of Compound C and Compound (I-5)

Compound B (3.8 g, 17 mmol) and butanesultone (4.6 g, 34 mmol) were reacted at 150° C. for 6 hours. The temperature of the reaction mixture was lowered to 60° C., and ethyl acetate was added thereto. The mixture was stirred at room temperature for 20 minutes. Ethyl acetate was removed by decantation, thereby obtaining Compound C as a resinous product. The product was used for the subsequent reaction without further purification to prepare the dye.

Compound C (5.4 g, 15 mmol) was dissolved in a mixed solvent of 15 ml of acetic acid and 27 ml of pyridine, and triethyl orthopropionate (10.6 g, 60 mmol) was added thereto. The temperature of the mixture was raised to 60° C., and triethylamine (2.8 ml) was added thereto. The mixture was then heated under reflux. The reaction mixture (solution) was poured into 200 ml of ethyl acetate, and the mixture was stirred for 2 hours, thereby obtaining triethylamine salt of Compound (I-5) as a resinous product. The product was dissolved in 20 ml of methanol, and the solution was heated under reflux. A methanol solution of sodium acetate (1.7 g) was added thereto, and the resulting mixture was heated under reflux for 30 minutes. Few droplets of isopropanol was added thereto, and the resulting solution was left to stand at room temperature overnight, thereby crystallizing the product. The resulting crystal was recovered by filtration and washed with ice-cooled methanol to obtain Compound (I-5) (3.2 g, yield: 55%).

$\lambda_{max}$=500.0 nm

Melting point=177° C. (dec.)

The spectral sensitizing dyes can be contained in silver halide emulsions by directly dispersing them in the emulsions or by dissolving them in a solvent such as water, methanol, ethanol, propanol, methyl cellosolve or 2,2,3,3-tetrafluoropropanol alone or a mixture thereof and adding the resulting solution to the emulsions. An aqueous solution may be prepared by using a base and added to the emulsions described in JP-B-44- 23389, JP-B-44-27555 and JP-B-57-22089. An aqueous solution or a colloidal dispersion may be prepared by using a surfactant and added to the emulsions described in U.S. Pat. Nos. 3,822,135 and 4,006,025. The spectral sensitizing dyes may be dissolved in a substantially water-immiscible solvent such as phenoxy ethanol, and the resulting solution may be dispersed in water or hydrophilic colloid and added to the emulsions. Further, the dyes may be directly dispersed in hydrophilic colloid and the resulting dispersion may be added to the emulsions described in JP-A-53-102733 and JP-A- 58-105141.

Furthermore, there may be used a method wherein water-insoluble dyes are dispersed in a water-soluble solvent without dissolving them, and the resulting dispersion is added to the emulsions as described in JP-B- 46-24185; and a method wherein water-insoluble dyes are mechanically crushed and dispersed in a water-soluble solvent, and the resulting dispersion is added to the emulsions described in JP-B-61-45217.

The photographic emulsions used in the present invention may be spectral-sensitized with methine dyes and other dyes in combination with the compounds according to the present invention. Examples of the dyes which can be used in combination with the compounds according to the present invention include cyanine dyes, merocyanine dyes, complex cyanine dyes, complex merocyanine dyes, holopolar cyanine dyes, hemicyanine dyes, styryl dyes and hemioxonol dyes. More preferred dyes are cyanine dyes, merocyanine dyes and complex merocyanine dyes. Any of basic heterocyclic nuclei conventionally used for the cyanine dyes can be applied to these dyes. Specific examples of the nuclei which can be applied to the dyes include pyrroline nucleus, oxazoline nucleus, thiazoline nucleus, pyrrole nucleus, oxazole nucleus, thiazole nucleus, selenazole nucleus, imidazole nucleus, tetrazole nucleus and pyridine nucleus; nuclei formed by condensing an aromatic hydrocarbon ring with these nuclei; and nuclei formed by condensing an aromatic hydrocarbon ring with these nuclei, such as indolenine nucleus, benzindolenine nucleus, indole nucleus, benzoxazole nucleus, naphthoxazole nucleus, benzthiazole nucleus, naphthothiazole nucleus, benzoselenazole nucleus, benzimidazole nucleus and quinoline nucleus. These nuclei may have one or more substituent groups attached to carbon atom(s).

Five-membered or six-membered heterocyclic nuclei such as pyrazoline-5-one nucleus, thiohydantoin nucleus, 2-thioxazoline-2,4-dione nucleus, thiazolidine- 2,4-dione nucleus, rhodanine nucleus and thiobarbituric acid nucleus as nuclei having a keto-methylene structure can be applied to merocyanine dyes and complex merocyanine dyes.

The compounds according to the present invention may be used either alone or in combination of two or more of them. The combinations of the sensitizing dyes are often used for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,303,377, 3,769,301, 3,814,609, 3,837,862 and 4,026,707, U.K. Patents 1,344,281 and 1,507,803, JP-B- 43-49336, JP-B-53-12375, JP-A-52-110618 and JP-A-52- 109925.

In addition to the compounds of the present invention, the emulsions may contain a dye which itself does not have a spectral sensitization effect or a substance which does not substantially absorb visible light, but has a supersensitization effect.

The compounds of the present invention may be added to the emulsions at any stage which is conventionally considered to he a useful stage during the preparation of the emulsions. Usually, the compounds are added at a stage between after completion of chemical sensitization and before coating. However, the compounds according to the present invention and chemical sensitizing agents may be simultaneously added to carry out simultaneously spectral sensitization and chemical sensitization as described in U.S. Pat. Nos. 3,628,969 and 4,225,666. Spectral sensitization may be conducted before chemical sensitization or the spectral sensitizing dyes may be added before completion of the formation of the precipitates of silver halide grains to commence spectral sensitization as described in JP-A-58-113928. Further, the sensitizing dyes may be added potionwise as described in U.S. Pat. No. 4,225,666. Namely, a part of the compound may be added before chemical sensitization, and the remainder thereof may be added after chemical sensitization. Furthermore, the compounds may be added at any stage during the course of the formation of silver halide grains as described in U.S. Pat. No. 4,183,756.

The compounds represented by formulae (I) to (IV) according to the present invention are used in an amount of from $4\times10^{-6}$ to $8\times10^{-3}$ mol, preferably from $5\times10^{-6}$ to $2\times10^{-3}$ mol, and more preferably from $1\times10^{-4}$ to $1\times10^{-3}$ mol, per mol of silver halide. When silver halide grains have a grain size of 0.2 to 1.2 μm which is a preferred grain size, an amount added of from $5\times10^{-5}$ to $2\times10^{-3}$ mol, preferably from $1\times10^{-4}$ to $1\times10^{-3}$ mol, and more preferably from $5\times10^{-4}$ to $1\times10^{-3}$ mol, per mol of silver halide is effective.

Grains contained in silver halide emulsions used in the present invention may have any grain size distribution. However, it is preferred that grains have such a grain size distribution that silver halide grains having a mean grain size of within the maximum grain size (average) ±20% is preferably 60% or more, more preferably 80% or more, of the total weight of the entire silver halide grains.

Silver halides used in the present invention include silver bromide, silver iodobromide, silver iodochlorobromide, silver chlorobromide and silver chloride.

Silver halide grains used in the present invention may have a regular crystal form such as a cubic, octahedral or tetradecahedral form, an irregular form such as a spherical or platy form, a crystal form having a defect such as twin or a composite form thereof.

Silver halide grains may be grains ranging from fine grains having a grain size of about 0.2 μm or less to larger-size grains-having a grain size (in terms of the diameter of the projected area of the grain) of about 10 μm. Polydisperse emulsions or monodisperse emulsions may be used.

The silver halide emulsions used in the photographic materials of the present invention can be prepared by using the methods described in *Research Disclosure* (RD) No. 17643 (December 1978), pp. 22–23 "I. Emulsion Preparation and Types"; *Research Disclosure* No. 18716 (November 1979), page 648; P. Glafkides, *Chimie et Physique Photographique* (Paul Morttel 1967); G. F. Duffin, *Photographic Emulsion Chemistry* (Focal Press 1966); and V. L. Zelikman et al., *Making and Coating Photographic Emulsion* (Focal Press 1964).

Monodisperse emulsions described in U.S. Pat. Nos. 3,754,628 and 3,655,394 and U.K. Patent 1,413,748 can be preferably used.

Emulsions comprising grains having such a grain size distribution that AgX grains having an aspect ratio (the ratio of diameter (in terms of the diameter of the corresponding circle) to thickness of grain) of about at least 3 is 50% or more of the projected areas of the entire AgX grains, can be used in the present invention. Tabular grains can be easily prepared by the methods described in Gutoff, *Photographic Science and Engineering,* Vol. 14, pp. 248–257 (1970), U.S. Pat. Nos. 4,434,226, 4,414,310, 4,433,048 and 4,439,520 and U.K. Patent 2,112,157.

In the preparation of silver halide emulsions comprising regular grains, grains having a desired size can be obtained by conducting nucleation and the growth of the grains by the double jet process while pAg is kept constant and supersaturation is kept at such a degree that re-nucleation does not occur. The method described in JP-A-54-48521 can be used. In a preferred embodiment thereof, an aqueous gelatin solution of potassium iodide and an aqueous ammonia solution of silver nitrate are added to an aqueous solution containing silver halide grains by changing the addition rate as a function of time. When the time function of the addition rate, pH, pAg, temperature, etc. are appropriately chosen, high-degree monodisperse silver halide emulsions can be obtained. The details thereof are described in *Photographic Science and Engineering,* Vol. 6, pp. 159–165 (1962), *Journal of Photographic Science,* Vol. 122, pp. 242–251 (1964), U.S. Pat. No. 3,655,394 and U.K. Patent 1,413,748.

The crystal structure may be uniform or different in halogen composition between the interior of the grain and the surface layer thereof. The crystal structure may be a laminar structure. These grains are disclosed in U.K. Patent 1,027,146, U.S. Pat. Nos. 3,505,068 and 4,444,877 and JP-A-60-222844. Silver halides having different compositions may be joined to each other by epitaxial growth. Silver halide may be joined to other compound than silver halide, such as silver rhodanide or lead oxide.

It is preferred that the grains contained in the silver halide emulsions used in the present invention have a distribution or structure with regard to the halogen composition thereof. Typical examples of the grains include double structural grains and core/shell type grains wherein the interior of the grain and the surface layer thereof are different in a halogen composition from each other as described in JP-B-43-13162, JP-A-61-215540, JP-A-60-222845 and JP-A-61-75337.

Further, triple structural grains and more layer structural grains as described in JP-A-60-222844 can be used without being limited to the double structural grains. Furthermore, silver halide having a different halogen composition from that of the core/shell type grain may be joined to the surfaces of the core/shell type double structural grains.

Grains having a structure in the interior of the grain can be prepared not only by the above-described enveloping structure but also by grains having a joined structure. Examples of these grains are disclosed in JP-A-59-133540, JP-A-58-108526, EP 199,290A-2, JP-B-58- 24772 and JP-A-59-16254. Crystals to be joined have a different composition from that of host crystals and are joined to the edges, corners and surfaces of host crystals. The joined crystals can be formed even when the host crystals have a uniform halogen composition or a core/shell type structure.

The grains having a joined structure can be formed by joining silver halides to each other or by combining silver halide with a silver salt compound which does not have a rock salt structure, such as silver rhodanide or silver carbonate. Further, non-silver salt compounds such as PbO can be used, so long as the non-silver salt compounds can be joined.

For example, when silver iodobromide grains have these structures, the grain in the core area of the core/shell type grain may have a higher silver iodide content, and the grain in the shell area may have a lower silver iodide content. Alternatively, the grain in the core area may have a lower silver iodide content, and the grain in the shell area may have a higher silver iodide content. Similarly, when the grains have a joined structure, the host crystal may have a higher silver iodide content, and the joining crystal may have a relatively lower silver iodide content. The content may be reverse to that described above.

The boundary between the areas where the halogen combinations are different from each other in the grain having these structures may be a distinct boundary or an indistinct boundary where a mixed crystal is formed by a difference in a halogen composition. Further, the boundary may be one where a change in the structure is continuously made.

The grains to be contained in the silver halide emulsions used in the present invention may be subjected to a rounding treatment as described in EP 0,096,727B1 or EP 0,064,412B1 or a surface-modifying treatment as described in DE 2,306,447C2 and JP-A-60-221320.

It is preferred that the silver halide emulsions used in the present invention are surface latent image type emulsions. However, internal latent image type emulsions can be used by choosing the conditions of developing solutions or development used as described in JP-A-59-133542. Further, shallow latent image type emulsions wherein a thin shell is fogged as described in JP-A-63-264740 can be preferably used.

Solvents for silver halide are useful for accelerating ripening. For example, it is known that an excess amount of halogen ions is allowed to exist in the reactor to accelerate ripening. Ripening can be accelerated merely by introducing the solvents for silver halide into the reactor. Other ripening agents may be used. The entire amount of the ripening agent may be blended with a dispersion medium in the reactor before the addition of a silver salt and a halide. The ripening agent together with one or more halides, a silver salt or a deflocculating agent may be introduced into the reactor. In another embodiment, the ripening agent may be separately introduced into the reactor at the stage of the addition of the halide and the silver salt.

Examples of the ripening agents other than the halogen ion include ammonia, amine compounds and thiocyanates such as alkali metal thiocyanates (particularly sodium thiocyanate, potassium thiocyanate) and ammonium thiocyanate.

It is very important that chemical sensitization such as typically sulfur sensitization and gold sensitization is carried out in the present invention. Photographic characteristics obtained by using the grains doped with at least $1\times10^{-4}$ mol of a polyvalent metal per mol of Ag do not have any feature in the non-after-ripened state. However, when the grains are chemical-sensitized, a remarkable effect can be obtained. Sites to be chemical-sensitized vary depending on the compositions, structures and forms of the grains contained in the emulsions and the use of the emulsions. The chemical sensitization nucleus may be buried in the interior of the grain, the nucleus may be buried in a shallow position from the surface of the grain, or the nucleus may be formed on the surface of the grain. It is particularly preferred that the chemical sensitization nucleus is formed in the vicinity of the surface of the grain. Namely, the surface latent image type emulsions are more effective than the internal latent image type emulsions.

Chemical sensitization can be made by using active gelatin as described in T. H. James, *The Theory of the Photographic Process,* 4th ed. pp. 67–76 (Macmillan 1977). Further, chemical sensitization can be made by using a sulfur, selenium, tellurium, gold, platinum, palladium or iridium sensitizing agent or a combination of two or more of these sensitizing agents at a pAg of 5 to 10, at a pH of 5 to 8 and at a temperature of 30° to 80° C. as described in *Research Disclosure,* Vol. 120, No. 12008 (April 1974), *Research Disclosure,* Vol. 34, No. 13452 (June 1975), U.S. Pat. Nos. 2,642,361, 3,297,446, 3,772,031, 3,857,711, 3,901,714, 4,266,018 and 3,904,415 and U.K. Patent 1,315, 755. Chemical sensitization can be made best in the presence of a gold compound and a thiocyanate compound, or in the presence of sulfur-containing compounds described in U.S. Pat. Nos. 3,857,711, 4,266,018 and 4,054,457 or sulfur-containing compounds such as hypo, thiourea compounds and rhodanine compounds. Chemical sensitization can be made in the presence of chemical sensitization aids. The chemical sensitization aids which can be used include conventional compounds which can inhibit fogging during the course of chemical sensitization and can increase sensitivity. Examples of chemical sensitization aid improvers are described in U.S. Pat. Nos. 2,131,038, 3,411,914 and 3,554, 757, JP-A-58-126526 and the aforesaid *Photographic Emulsion Chemistry* written by G. F. Duffin, pp. 138–143 (Focal Press 1966).

The silver halide emulsions prepared in the present invention can be applied to any of color photographic materials and black and white photographic materials.

Examples of the color photographic materials to which the silver halide emulsions can be applied include color paper, color films for photographing and reversal color films. Examples of the black and white photographic materials include X-ray films, general-purpose films for photographing and films for printing photographic materials.

Additives of the photographic materials using the emulsions according to the present invention are not particularly limited. For example, additives used are described in *Research Disclosure* (RD) Vol. 176, No. 17643 and ibid. Vol. 187, No. 18716, and places where the additives are described are listed below.

Further, conventional photographic additives which can be used in the present invention are also described in the above-described two *Research Disclosures* and are listed below.

| | Additive | RD 17643 | RD 18716 |
|---|---|---|---|
| 1. | Chemical Sensitizing Agent | page 23 | right column of page 648 |
| 2. | Sensitivity Increaser | — | right column of page 648 |
| 3. | Spectral Sensitizing Agent, Supersensitizing Agent | pages 23 to 24 | right column of page 648 to right column of page 649 |
| 4. | Brightener | page 24 | — |
| 5. | Anti-fogging Agent, Stabilizer | pages 24 to 25 | right column of page 649 |
| 6. | Light Absorber, Filter Dye, UV Absorber | pages 25 to 26 | right column of page 649 to left column of page 650 |
| 7. | Anti-staining Agent | right column of page 25 | left column to right column of page 650 |
| 8. | Dye Image Stabilizer | page 25 | — |
| 9. | Hardening Agent | page 26 | left column of page 651 |
| 10. | Binder | page 26 | left column of page 651 |
| 11. | Plasticizer, Lubricant | page 27 | right column of page 650 |
| 12. | Coating Aid, Surfactant | pages 26 to 27 | right column of page 650 |
| 13. | Antistatic Agent | page 27 | right column of page 650 |

The photographic materials of the present invention contain colloidal silver and dyes to prevent irradiation and halation and particularly to ensure the separation of a spectral sensitivity distribution in each light-sensitive layer and safety against safelight.

Examples of the dyes include oxonol dyes having a pyrazolone nucleus, a barbituric nucleus or a barbituric acid nucleus described in U.S. Pat. Nos. 506,385, 1,177,429, 1,131,884, 1,338,977, 1,385,371, 1,467,214, 1,438,102 and 1,553,516, JP-A-48-85130, JP-A- 49-114420, JP-A-52-117123, JP-A-55-161233, JP-A-59- 111640, JP-B-39-22069, JP-B-43-13168, JP-B-62-273527, and U.S. Pat. Nos. 3,247,127, 3,469,985 and 4,078,933; oxonol dyes described in U.S. Pat. Nos. 2,533,472 and 3,379,533, U.K. Patent 1,278,621, JP-A-1-134447, and JP-A- 1-183652; azo dyes described in U.K. Patents 575,691, 680,631, 599,623, 786, 907, 907,125 and 1,040,609, U.S. Pat. No. 4,255,326 and JP-A-59-211043; azomethine dyes described in JP-A-50-100116, JP-A-54-118247 and U.K. Patents 2,014,598 and 750,031; anthraquinone dyes described in U.S. Pat. No. 2,865,752; arylidene dyes described in U.S. Pat. Nos. 2,538, 009, 2,688,541 and 2,538,008, U.K. Patents 584,609 and 1,210,252, JP-A-50- 40625, JP-A-51-3623, JP-A-51-10927, JP-A-54-118247, JP-B- 48-3286 and JP-B-59-37303; styryl dyes described in JP-B-28-3082, JP-B-44-16594 and JP-B-59-28898; triarylmethane dyes described in U.K. Patents 446,538 and 1,335,422 and JP-A-59-228250; merocyanine dyes described in U.K. Patents 1,075,653, 1,153,341, 1,284, 730, 1,475,228 and 1,542,807; and cyanine dyes described in U.S. Pat. Nos. 2,843,486 and 3,294,539 and JP-A-1-291247.

The following methods can be used to prevent these dyes from diffusing.

For example, a ballast group is introduced into the dyes to make the dyes nondiffusing.

A method wherein a hydrophilic polymer having an opposite charge to that of the dissociated anionic dye is allowed to coexist as a mordant in the same layer, and the dye is localized in a specific layer by the interaction with the dye molecular, is disclosed in U.S. Pat. Nos. 2,548,564, 4,124,386 and 3,625,694.

Further, a method wherein a specific layer is dyed by using a water-insoluble dye solid is disclosed in JP-A-56-12639, JP-A-55-155350, JP-A-55-155351, JP-A- 63-27838, JP-A-63-197943 and European Patent 15,601.

A method wherein a specific layer is dyed by using metal salt fine particles having a dye adsorbed thereon is disclosed in U.S. Pat. Nos. 2,719,088, 2,496,841 and 2,496,843 and JP-A-60-45237.

Examples of anti-fogging agents and stabilizers which can be preferably used include azoles (e.g., benzthiazolium salts, nitroimidazoles, nitrobenzimidazoles, chlorobenzimidazoles, bromobenzimidazoles, nitroindazoles, benztriazoles, aminotriazoles); mercapto compounds (e.g., mercaptothiazoles, mercaptobenzthiazoles, mercaptobenzimidazoles, mercaptothiadiazoles, mercaptotetrazoles (particularly 1-phenyl-5-mercaptotetrazole), mercaptopyrimidines, mercaptotriazines); thio-keto compounds such as oxazoline thion; azaindenes (e.g., triazaindenes, tetrazaindenes (particularly 4-hydroxy-substituted( 1,3,3a,7)tetrazaindenes), pentazaindenes), benzenethiosulfonic acid; benzenesulfinic acid; and benzenesulfonic acid amide.

Preferred color couplers are nondiffusing couplers having a hydrophobic group called a ballast group in the molecule and polymer couplers. Any of four equivalent type or two equivalent type to a silver ion can be used. Colored couplers having an effect of correcting color and couplers releasing a restrainer during development (called DIR couplers) may be used. Further, there may be used non-color forming DIR coupling compounds which produce colorless compounds by coupling reaction and release a restrainer.

Preferred examples of the couplers are described in JP-A-62-215272 (line 4 of right upper column of page 91 to line 6 of left upper column of page 121), JP-A-2- 33144 (line 14 of right upper column of page 3 to last line of left upper column of page 18; and line 6 of right upper upper column of page 30 to line 11 of right lower column of page 35) and European Patent 96,570 (lines 15 to 27 of page 4; line 30 of page 5 to last line of page 28; lines 29 to 31 of page 45; and line 23 of page 47 to line 50 of page 63).

Examples of magenta couplers include 5-pyrazolone couplers, pyrazolobenzimidazole couplers, pyrazolotriazole couplers, pyrazolotetrazole couplers, cyanoacetylcoumarone couplers and open chain acylacetonitrile couplers. Examples of yellow couplers include acylacetamide couplers (e.g., benzoylacetanilides, pivaloylacetanilides). Examples of cyan couplers include naphthol couplers and phenol couplers. Specific examples of the cyan couplers which can be preferably used from the viewpoint of providing images having excellent fastness include phenol couplers having an ethyl group at the meta-position of phenol nucleus, 2,5-diacylamino-substituted phenol couplers, phenol couplers having a phenylureido group at the 2-position and an acylamino group at the 5-position, and naphthol couplers having a sulfonamido or amido group at the 5-position, disclosed in U.S. Pat. Nos. 3,772,002, 2,772,162, 3,768,308, 4,126,396, 4,334,011, 4,327,173, 3,446,622, 4,333,999, 4,451,559 and 4,427,767.

Two or more members of the above couplers may be added to the same layer to meet characteristics necessary for the photographic materials. The same compound may be added to two or more different layers.

Typical examples of anti-fading agents include hydroquinones, 6-hydroxychromans, 5-hydroxycoumarans, spirochroman, p-alkoxyphenols, hindered phenols such as bisphenols, gallic acid derivatives, methylenedioxybenzenes, aminophenols, hindered amines and ethers and esters obtained by silylating or alkylating a phenolic hydroxy group of these compounds. Further, metal complexes such as typically (bissalicylaldoximato)nickel complex and (bis-N, N-dialkyldithiocarbamato)nickel complex can be used.

Any of conventional processing methods can be applied to the photographic processing of the photographic materials of the present invention. Processing solutions may contain conventional compounds. The processing temperature is usually from 18° to 50° C. However, a temperature of lower than 18° C. or a temperature of higher than 50° C. may be used. Development (black-and-white photographic processing) for forming a silver image or color photographic processing comprising development for forming a dye image can be used according to the purpose.

Black-and-white developing solutions may contain conventional developing agents such as dihydroxybenzenes (e.g., hydroquinone), 3-pyrazolidones (e.g., 1-phenyl-3-pyrazolidone) and aminophenols (e.g., N-methyl-p-aminophenol) alone or in combination thereof.

Generally, color developing solutions comprise aqueous alkaline solutions containing color developing agents. Examples of the color developing agents which can be used in the present invention include conventional primary aromatic amine developing agents such as phenylenediamines (e.g., 4-amino-N,N-diethylaniline, 3-methyl- 4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-β-methanesulfonamidoethylaniline, 4-amino-3-methyl-N-ethyl-β-methoxyethylaniline).

In addition to the above-described compounds, those described in L. F. A. Mason, *Photographic Processing Chemistry*, pp. 226–229 (Focal Press 1966), U.S. Pat. Nos. 2,193,015 and 2,592,364 and JP-A-48-64933 may be used.

The developing solutions may contain pH buffering agents such as sulfites, carbonates, borates and phosphates of alkali metal, restrainers or anti-fogging agents such as bromides, iodides and organic anti-fogging agents. If desired, the developing solutions may optionally contain water softeners, preservatives such as hydroxylamine, organic solvents such as benzyl alcohol and diethylene glycol, development accelerators such as polyethylene glycol, quaternary ammonium salts and amines, dye forming couplers, competitive couplers, fogging agents such as sodium boron hydride, auxiliary developing agents such as 1-phenyl-3-pyrazolidone, tackifiers, polycarboxylic acid chelating agents described in U.S. Pat. No. 4,083,723 and antioxidants described in West German Patent Laid Open (OLS) No. 2,622,950.

After the photographic materials are processed with the color developing solutions, they are usually bleached. Bleaching may be carried out simultaneously with fixing. Alternatively, bleaching and fixing may be separately carried out. Examples of bleaching agents which can be used in the bleaching solutions include the compounds of polyvalent metals such as iron (III), cobalt (III), chromium (VI) and copper (II), peracids, quinones and nitton compounds. Specific examples of the bleaching agents include ferricyanides, dichromates, organic complex salts of iron (III) and cobalt (III) such as complex salts of aminopolycarboxylic acids (e.g., ethylenediaminetetraacetic acid, nitrilotriacetic acid, 1,3-diamino-2-propanoltetraacetic acid) and complex salts of organic acids (e.g., citric acid, tartaric acid, malic acid), persulfate, permanganate and nitrosophenol. Of these compounds, potassium ferricyanide, sodium ethylenediaminetetraacetato ferrate and ammonium ethylenediaminetetraacetato ferrate are particularly useful. The iron (III) complex salts of ethylenediaminetetraacetic acid are useful for the bleaching solutions as well as for the monobath bleaching-fixing solutions.

The bleaching solutions and the bleaching-fixing solutions may contain bleaching accelerators described in U.S. Pat. Nos. 3,042,520 and 3,241,966, JP-B-45-8506 and JP-B-45-8836, thiol compounds described in JP-A-53- 65732 and various additives. After bleaching or bleaching-fixing, the photographic materials may be rinsed, or may be subjected to a stabilizing treatment without rinsing.

Supports which can be used in the present invention include transparent films such as cellulose naphthalate film and polyethylene terephthalate film and reflection type supports which are conventionally used for the photographic materials.

The reflection support used in the present invention refers to a support which has increased reflecting properties to make clear an image dye formed on the silver halide emulsion layer. Examples of the reflection support include supports obtained by coating a support with a hydrophobic resin containing a light reflecting material such as titanium oxide, zinc oxide, calcium carbonate or calcium sulfate dispersed therein and supports comprising a light reflecting material dispersed therein to increase reflectance in the wavelength region of visible light on the support. Specific examples of the supports include baryta paper, polyethylene-coated paper, polypropylene synthetic paper, transparent supports coated with a reflecting layer, transparent supports containing the reflecting materials dispersed therein. Specific examples of the transparent supports include glass sheet, films of polyesters such as polyethylene terephthalate, cellulose triacetate and cellulose nitrate, polyamide films, polycarbonate films, polystyrene films and vinyl chloride resin films. These supports can be properly chosen according to the purpose of use.

Exposure for obtaining a photographic image may be conducted by conventional methods. Any of conventional light sources such as natural light (sunlight), tungsten lamp, fluorescent lamp, mercury vapor lamp, xenon arc lamp, carbon arc lamp, xenon flash lamp, laser, LED and CRT can be used. The exposure time can be widely varied. For example, the exposure time may be from 1/1000 sec to 1 sec which is used for cameras. A shorter exposure time than 1/1000 sec can be used. For example, when xenon flash lamp is used, the exposure time of from $1/10^4$ sec to $1/10^6$ sec can be used. Further, a longer exposure time than 1 sec can be used. If desired, color filters may be used to control the spectral composition of light for use in exposure. Exposure may be conducted by laser beams. Further, exposure may be conducted by light emitted from phosphors excited with electron beams, X-rays, gamma rays or alpha rays.

The present invention will now be illustrated in greater detail with reference to the following examples, however, it should be understood that the present invention is not construed as being limited thereto.

EXAMPLE 1

Preparation of Emulsion

To a container containing an aqueous solution of 30 g of gelatin and 6 g of potassium bromide in one liter of water kept at 60° C. with stirring, there were added an aqueous solution of 5 g of silver nitrate and an aqueous solution of potassium bromide containing 0.15 g of potassium iodide over a period of one minute by the double jet process. Further, an aqueous solution of 145 g of silver nitrate and an aqueous solution of potassium bromide containing 4.2 g of potassium iodide were added thereto by the double jet process. The addition was made at an accelerating flow rate such that the flow rate at the time of completion of the addition was 5 times the flow rate at the time of the commencement of the addition. After completion of the addition, soluble salts were removed by the precipitation method. The temperature of the resulting emulsion was raised to 40° C., and 75 g of gelatin was added thereto. The pH of the emulsion was adjusted to 6.7. The resulting emulsion comprised tabular grains having a mean grain size (in terms of the average of the diameters of the corresponding projected areas) of 0.98 μm, an average grain thickness of 0.138 μm and a silver iodide content of 3 mol %. The emulsion was chemical-sensitized by a combination of gold sensitization with sulfur sensitization.

Preparation of Photographic Material 101 (Sample No. 1)

The surface protective layer was coated by using an aqueous gelatin solution containing polysodium styrenesulfonate having an average molecular weight of 8,000, fine particles of polymethyl methacrylate (having an average particle size of 3.0 μm), polyethylene oxide and a hardening agent.

The following Dye A (500 mg/liter of Ag) as a sensitizing dye and potassium iodide (200 mg/liter of Ag) were added to the above emulsion.

Dye A

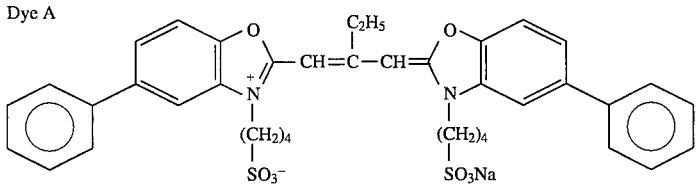

Sample Nos. 102 to 109 were prepared in the same manner as in the preparation of Sample No. 101 except that sensitizing dyes shown in Table 1 below were used in place of the sensitizing dye used in the preparation of Sample No. 101.

Further, 4-hydroxy-6-methyl-1,3,3a,7-tetrazaindene and 2,6-bis(hydroxyamino)-4-diethylamino-1,3,5-triazine as stabilizers, nitton, trimethylol propane as a dry anti-fogging agent, a coating aid and a hardening agent were added thereto to prepare each coating solution. The coating solution and the surface protective layer were co-coated on both sides of a polyethylene terephthalate support to prepare each of the photographic materials. The coating weight of silver per one side was 2 g/m$^2$.

Preparation of Development Processing Agent Kit

A development processing kit (concentrated liquid) consisting of the following Part (A), Part (B) and Part (C) was prepared.

| Part (A) For 10 l of Developer (Working Solution) | |
|---|---|
| Potassium Hydroxide | 291 g |
| Potassium Sulfite | 442 g |
| Sodium Hydrogencarbonate | 75 g |
| Boric Acid | 10 g |
| Diethylene Glycol | 120 g |
| Ethylenediaminetetraacetic Acid | 17 g |

-continued

| | |
|---|---|
| 5-Methylbenztriazole | 0.6 g |
| Hydroquinone | 300 g |
| 1-Phenyl-4,4-dimethyl-3-pyrazolidone | 20 g |
| Water to make | 2.5 l |
| The pH was adjusted to 1.1. | |
| Part (B) For 10 l of Developer (Working Solution) | |
| Triethylene Glycol | 20 g |
| 5-Nitroindazole | 2.5 g |
| Glacial Acetic Acid | 3 g |
| 1-Phenyl-3-pyrazolidone | 15 g |
| Water to make | 250 ml |
| Part (C) For 10 l of Developer (Working Solution) | |
| Glutaric Aldehyde | 99 g |
| Sodium Metabisulfite | 126 g |

-continued

| | |
|---|---|
| Water to make | 250 ml |

The following starter having the following composition was prepared.

| Starter | |
|---|---|
| Glacial Acetic Acid | 720 g |
| Potassium Bromide | 300 g |
| Water to make | 1.5 l |

Preparation of Developing Solution

To about 6 l of water with stirring, there were added 2.5 l of Part (A), 250 ml of Part (B) and 250 ml of Part (C) in order, and these parts were dissolved. Water was added thereto to make the total amount of 10 l.

Subsequently, the starter in an amount of 20 ml per liter of the working solution was added.

Fixing was conducted by using Fuji F (manufactured by Fuji Photo Film Co., Ltd.).

Rinsing was conducted by using water containing 0.5 g of disodium ethylenediaminetetraacetate dihydrate (antifungal agent) per liter.

Development processing was carried out by roller conveying type automatic processor system shown in Table 2.

TABLE 2

| Processing Stage | Temperature | Processing Time |
|---|---|---|
| Development | 35° C. | 12.5 sec |
| Fixing | 30° C. | 10 sec |
| Rinsing and Squeeze | 20° C. | 12.5 sec |
| Drying | 50° C. | 12.5 sec |

Fresh photographic sensitivity (in terms of the relative sensitivity when the sensitivity of Sample No. 101 is referred to as 100) obtained after processing and the sensitivity obtained after storage at 50° C. and 80% RH for 3 days are shown in Table 3 below.

TABLE 3

| Sample No. | Sensitizing Dye | Fresh Sensitivity | Sensitivity after Storage at 50° C. and 80% RH for 3 days | Remarks |
|---|---|---|---|---|
| 101 | Dye A | 100 | 70 | Comparison |
| 102 | Dye B* | 85 | 60 | Comparison |
| 103 | I-1 | 109 | 85 | Invention |
| 104 | I-2 | 112 | 95 | Invention |
| 105 | I-4 | 121 | 110 | Invention |
| 106 | I-5 | 110 | 101 | Invention |
| 107 | II-1 | 108 | 105 | Invention |
| 108 | II-4 | 104 | 102 | Invention |
| 109 | II-7 | 120 | 115 | Invention |

*Dye B:

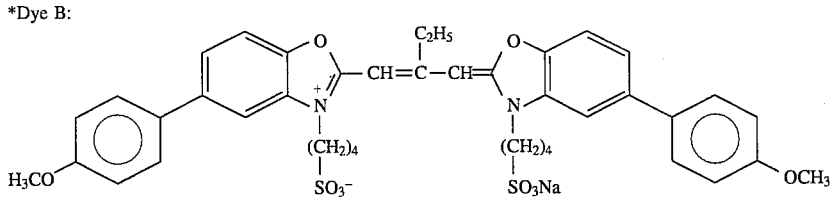

As is apparent from the results shown in Table 1, any of the emulsions containing the compounds according to the present invention has increased sensitivity and causes hardly a lowering in sensitivity with the passage of time.

EXAMPLE 2

Preparation of Sample No. 201

The following layers having the following compositions were coated on an undercoated cellulose triacetate film of 127 μm in thickness to prepare a multi-layer color photographic material as Sample No. 201. Numerals described below represent coating weights per $m^2$. The effects of the compounds described below are not limited to use described below.

| First Layer: Antihalation Layer | |
|---|---|
| Black Colloidal Silver | 0.20 g |
| Gelatin | 1.9 g |
| Ultraviolet Light Absorber U-1 | 0.1 g |
| Ultraviolet Light Absorber U-3 | 0.04 g |
| Ultraviolet Light Absorber U-4 | 0.1 g |
| High-Boiling Organic Solvent Oil-1 | 0.1 g |
| Dispersion of Fine Crystal Solid of Dye E-1 | 0.1 g |
| Second Layer: Interlayer | |
| Gelatin | 0.40 g |

| | |
|---|---|
| Compound Cpd-C | 5 mg |
| Compound Cpd-J | 5 mg |
| Compound Cpd-K | 3 mg |
| High-Boiling Organic Solvent Oil-3 | 0.1 g |
| Dye D-4 | 0.4 mg |
| Third Layer: Interlayer | |
| Fine-Grain Silver Iodobromide Emulsion wherein the surface of the grain and the interior thereof were fogged (mean grain size: 0.06 μm; a coefficient of variation: 18%; AgI content: 1 mol %) (in terms of silver) | 0.05 g |
| Gelatin | 0.4 g |
| Fourth Layer: Low-Sensitivity Red-Sensitive Emulsion Layer | |
| Emulsion A (in terms of silver) | 0.1 g |
| Emulsion B (in terms of silver) | 0.4 g |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Compound Cpd-C | 10 mg |
| High-Boiling Organic Solvent Oil-2 | 0.1 g |
| Additive P-1 | 0.1 g |
| Fifth Layer: Intermediate-Sensitivity Red-Sensitive Emulsion Layer | |
| Emulsion B (in terms of silver) | 0.2 g |
| Emulsion C (in terms of silver) | 0.3 g |
| Gelatin | 0.8 g |
| Coupler C-1 | 0.2 g |
| Coupler C-2 | 0.05 g |
| Coupler C-3 | 0.2 g |
| High-Boiling Organic Solvent Oil-2 | 0.1 g |
| Additive P-1 | 0.1 g |
| Sixth Layer; High-Sensitivity Red-Sensitive Emulsion Layer | |
| Emulsion D (in terms of silver) | 0.4 g |
| Gelatin | 1.1 g |
| Coupler C-1 | 0.3 g |
| Coupler C-2 | 0.1 g |
| Coupler C-3 | 0.7 g |
| Additive P-1 | 0.1 g |
| Seventh Layer: Interlayer | |
| Gelatin | 0.6 g |
| Additive M-1 | 0.3 g |
| Color Mixing Inhibitor Cpd-1 | 2.6 mg |
| Ultraviolet Light Absorber U-1 | 0.01 g |
| Ultraviolet Light Absorber U-2 | 0.002 g |
| Ultraviolet Light Absorber U-5 | 0.01 g |
| Dye D-1 | 0.02 g |
| Compound Cpd-C | 5 mg |
| Compound Cpd-J | 5 g |
| Compound Cpd-K | 5 g |
| High-Boiling Organic Solvent Oil-1 | 0.02 g |
| Eighth Layer: Interlayer | |
| Silver Iodobromide Emulsion wherein the surface layer and the interior thereof were fogged (mean grain size: 0.06 μm; a coefficient of variation: 16%; AgI content: 0.3 mol %) (in terms of silver) | 0.02 g |
| Gelatin | 1.0 g |
| Additive P-1 | 0.2 g |
| Color Mixing Inhibitor Cpd-A | 0.1 g |
| Ninth Layer: Low-Sensitivity Green-Sensitive Emulsion Layer | |
| Emulsion E (in terms of silver) | 0.1 g |
| Emulsion F (in terms of silver) | 0.2 g |
| Emulsion G (in terms of silver) | 0.2 g |
| Gelatin | 0.5 g |
| Coupler C-4 | 0.1 g |

| | |
|---|---|
| Coupler C-7 | 0.05 g |
| Coupler C-8 | 0.20 g |
| Compound Cpd-B | 0.03 g |
| Compound Cpd-C | 10 mg |
| Compound Cpd-D | 0.02 g |
| Compound Cpd-E | 0.02 g |
| Compound Cpd-F | 0.02 g |
| Compound Cpd-G | 0.02 g |
| High-Boiling Organic Solvent Oil-1 | 0.1 g |
| High-Boiling Organic Solvent Oil-2 | 0.1 g |
| Tenth Layer: Intermediate-Sensitivity Green-Sensitive Emulsion Layer | |
| Emulsion G (in terms of silver) | 0.3 g |
| Emulsion H (in terms of silver) | 0.1 g |
| Gelatin | 0.6 g |
| Coupler C-4 | 0.1 g |
| Coupler C-7 | 0.2 g |
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-G | 0.05 g |
| High-Boiling Organic Solvent Oil-2 | 0.01 g |
| Eleventh Layer: High-Sensitivity Green-Sensitive Emulsion Layer | |
| Emulsion I (in terms of silver) | 0.5 g |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-C | 5 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-J | 5 mg |
| Compound Cpd-K | 5 mg |
| High-Boiling Organic Solvent Oil-1 | 0.02 g |
| High-Boiling organic Solvent Oil-2 | 0.02 g |
| Twelfth Layer: Interlayer | |
| Gelatin | 0.6 g |
| Thirteenth Layer: Yellow Filter Layer | |
| Yellow Colloidal Silver (in terms of silver) | 0.07 g |
| Gelatin | 1.1 g |
| Color Mixing Inhibitor Cpd-A | 0.01 g |
| High-Boiling Organic Solvent Oil-1 | 0.01 g |
| Dispersion of Crystallite Solid of Dye E-2 | 0.05 g |
| Fourteenth Layer: Interlayer | |
| Gelatin | 0.6 g |
| Fifteenth Layer: Low-Sensitivity Blue-Sensitive Emulsion Layer | |
| Emulsion J (in terms of silver) | 0.2 g |
| Emulsion K (in terms of silver) | 0.3 g |
| Emulsion L (in terms of silver) | 0.1 g |
| Gelatin | 0.8 g |
| Coupler C-5 | 0.2 g |
| Coupler C-6 | 0.1 g |
| Coupler C-10 | 0.4 g |
| Sixteenth Layer: Intermediate-Sensitivity Blue-Sensitive Emulsion Layer | |
| Emulsion L (in terms of silver) | 0.1 g |
| Emulsion M (in terms of silver) | 0.4 g |
| Gelatin | 0.9 g |
| Coupler C-5 | 0.3 g |
| Coupler C-6 | 0.1 g |
| Coupler C-10 | 0.1 g |
| Seventeenth Layer: High-Sensitivity Blue-Sensitive Emulsion Layer | |

-continued

| | |
|---|---|
| Emulsion N (in terms of silver) | 0.4 g |
| Gelatin | 1.2 g |
| Coupler C-5 | 0.3 g |
| Coupler C-6 | 0.6 g |
| Coupler C-10 | 0.1 g |

-continued

| | |
|---|---|
| Eighteenth Layer: First Protective Layer | |
| Gelatin | 0.7 g |
| Ultraviolet Light Absorber U-1 | 0.2 g |
| Ultraviolet Light Absorber U-2 | 0.05 g |
| Ultraviolet Light Absorber U-5 | 0.3 g |
| Formalin Scavenger Cpd-H | 0.4 g |
| Dye D-1 | 0.1 g |
| Dye D-2 | 0.05 g |
| Dye D-3 | 0.1 g |
| Nineteenth Layer: Second Protective Layer | |
| Colloidal Silver (in terms of silver) | 0.1 mg |
| Fine-Grain Silver Iodobromide Emulsion (mean grain size: 0.06 μm, AgI content: 1 mol %) (in terms of silver) | 0.1 g |
| Gelatin | 0.4 g |
| Twentieth Layer: Third Protective Layer | |
| Gelatin | 0.4 g |
| Polymethyl Methacrylate (average particle size: 1.5 μm) | 0.1 g |
| Methyl Methacrylate/Acrylic Acid (4:6) Copolymer (average particle size: 1.5 μm) | 0.1 g |
| Silicone Oil | 0.03 g |
| Surfactant W-1 | 3.0 mg |
| Surfactant W-2 | 0.03 g |

Additives F-1 to F-8 in addition to the above-described compositions were added to all of the emulsion layers. Further, hardening agent H-1 for gelatin and surfactants W-3, W-4, W-5 and W-6 for coating and emulsifying in addition to the above-described compositions were added to each layer.

Furthermore, phenol, 1,2-benzisothiazoline-3-one, 2-phenoxyethanol and phenethyl alcohol as preservative and antifungal agent were added.

Silver iodobromide emulsions used in the preparation of Sample No. 201 are shown in Table 4 below.

Spectral sensitizing dyes added to Emulsions A to N are shown in Table 5 below.

TABLE 4

| Emulsion | Type of Grain | Mean Grain Size in Terms of Average Diameter of Corresponding Spheres (μm) | Coefficient of Variation (%) | AgI Content (%) |
|---|---|---|---|---|
| A | Monodisperse tetradecahedral grains | 0.28 | 16 | 3.7 |
| B | Monodisperse cubic internal latent image type grains | 0.30 | 10 | 3.3 |
| C | Monodisperse tabular grains, average aspect ratio: 4.0 | 0.38 | 18 | 5.0 |
| D | Tabular grains, average aspect ratio: 8.0 | 0.68 | 25 | 2.0 |
| E | Monodisperse cubic grains | 0.20 | 17 | 4.0 |
| F | Monodisperse cubic grains | 0.23 | 16 | 4.0 |
| G | Monodisperse cubic internal latent image type grains | 0.28 | 11 | 3.5 |
| H | Monodisperse cubic internal latent image type grains | 0.32 | 9 | 3.5 |
| I | Tabular grains, average aspect ratio: 9.0 | 0.80 | 28 | 1.5 |
| J | Monodisperse tetradecahedral grains | 0.30 | 18 | 4.0 |
| K | Monodisperse tabular grains, average aspect ratio: 7.0 | 0.45 | 17 | 4.0 |
| L | Monodisperse cubic internal latent image type grains | 0.46 | 14 | 3.5 |
| M | Monodisperse tabular grains, average aspect ratio: 10.0 | 0.55 | 13 | 4.0 |
| N | Tabular grains, average aspect ratio; 12.0 | 1.00 | 33 | 1.3 |

TABLE 5

| Emulsion | Sensitizing Dye | Amount added per mol of Silver Halide (g) |
|---|---|---|
| A | S-7 | 0.285 |
| B | S-7 | 0.27 |
| C | S-7 | 0.28 |
| D | S-7 | 0.27 |
| E | S-3 | 0.5 |
| | S-4 | 0.1 |
| F | S-3 | 0.3 |
| | S-4 | 0.1 |
| G | S-3 | 0.25 |
| | S-4 | 0.10 |
| | S-8 | 0.05 |
| H | S-3 | 0.2 |
| | S-4 | 0.06 |
| | S-8 | 0.05 |
| I | S-3 | 0.3 |
| | S-4 | 0.07 |
| | S-8 | 0.1 |
| J | S-6 | 0.2 |
| | S-5 | 0.05 |
| K | S-6 | 0.2 |
| | S-5 | 0.05 |
| L | S-6 | 0.22 |
| | S-5 | 0.06 |
| M | S-6 | 0.15 |
| | S-5 | 0.04 |
| N | S-6 | 0.22 |
| | S-5 | 0.06 |

The compounds used in Example 2 are shown below.

C-1
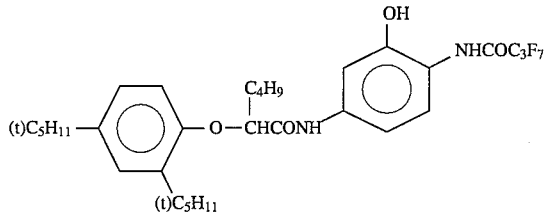
C-2
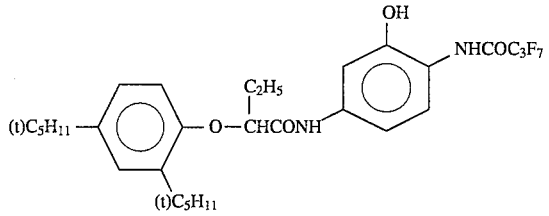
C-3
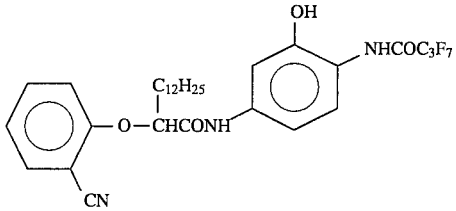
C-4
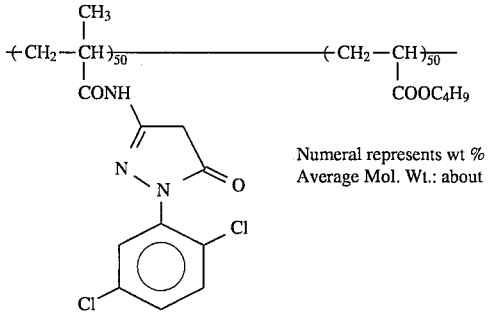
Numeral represents wt %
Average Mol. Wt.: about 25,000
C-5
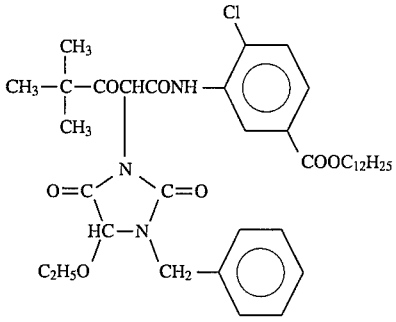
C-6
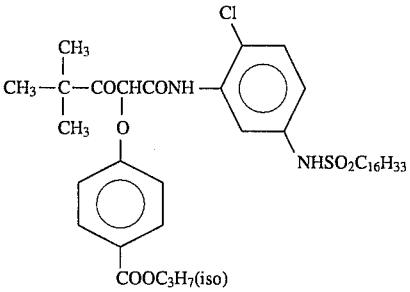
C-7
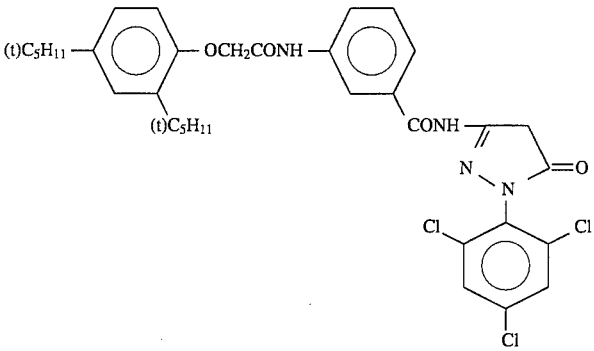

-continued
C-8
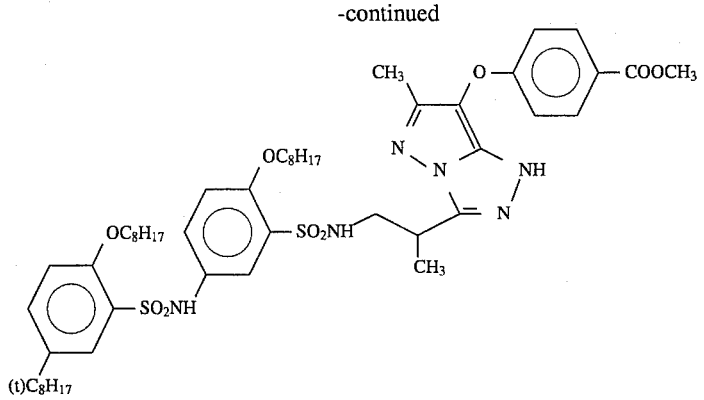
C-9
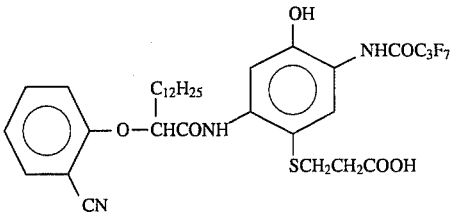
C-10
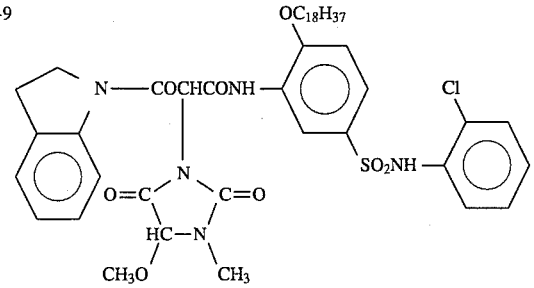
Dibutyl Phthalate Oil-1
Tricresyl Phosphate Oil-2
Oil-3
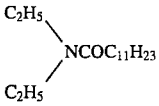
Cpd-A
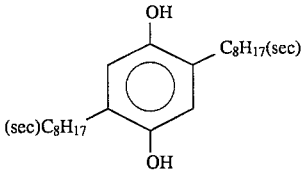
Cpd-B
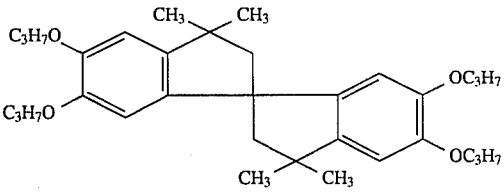
Cpd-C
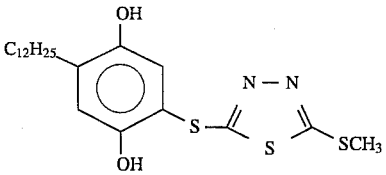
Cpd-D
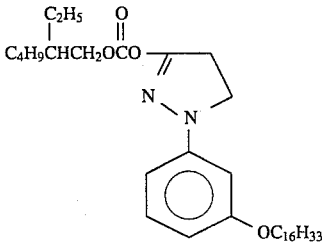
Cpd-E
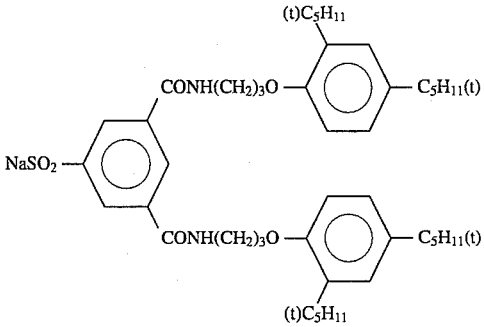
Cpd-F
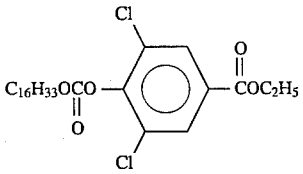
Cpd-G
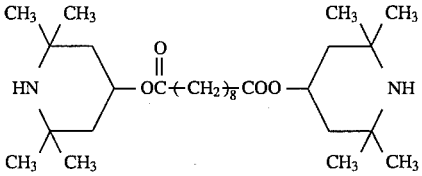

-continued
Cpd-H
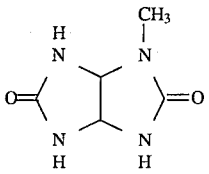
Cpd-I
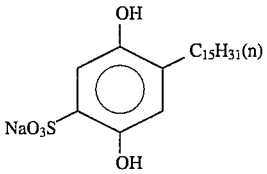
Cpd-J
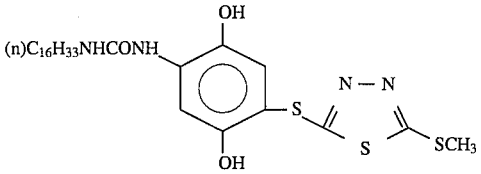
Cpd-K
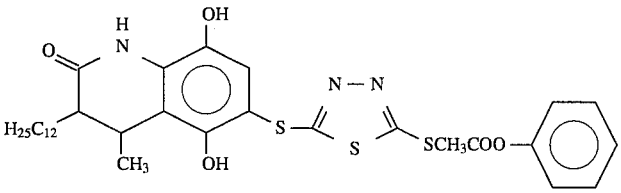
U-1
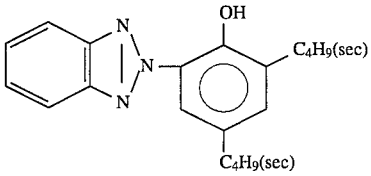
U-2
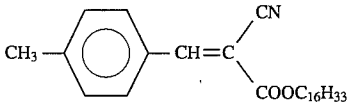
U-3
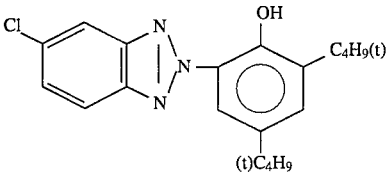
U-4
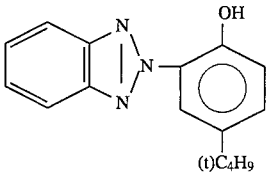
U-5
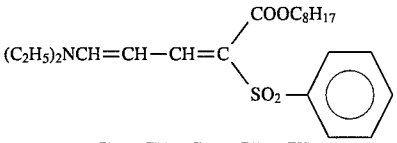
D-1
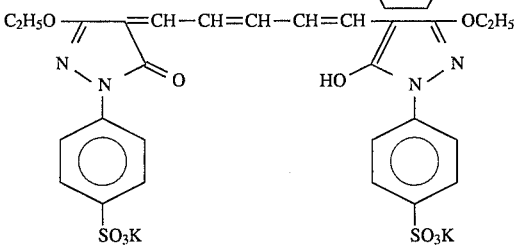
D-2
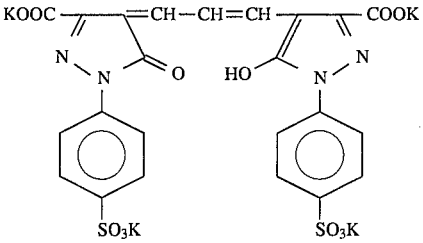
D-3
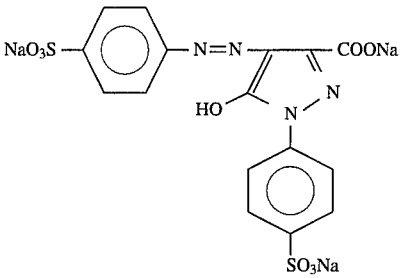

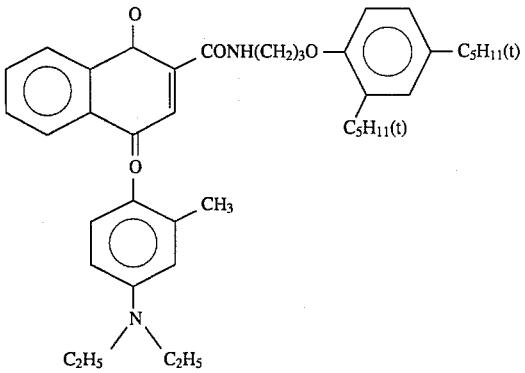
-continued
D-4
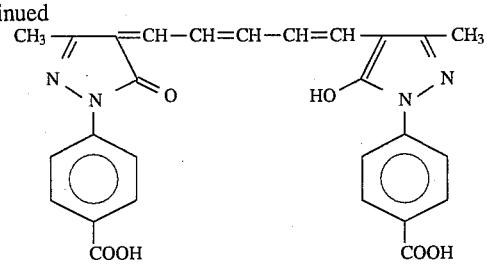
E-1
E-2
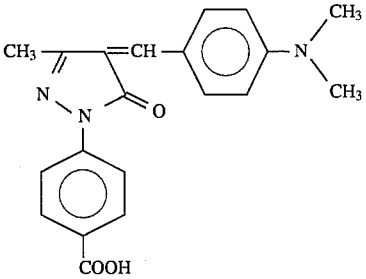
H-1
$CH_2{=}CH{-}SO_2{-}CH_2{-}CONH{-}CH_2$
$CH_2{=}CH{-}SO_2{-}CH_2{-}CONH{-}CH_2$
W-1
$C_8F_{17}SO_2NHCH_2CH_2CH_2OCH_2CH_2\overset{\oplus}{N}(CH_3)_3$
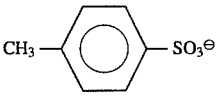
W-2
$C_8F_{17}SO_2N(C_3H_7)CH_2COOK$
W-3
$NaO_3S{-}CH(CH_2COOCH_2CH(C_2H_5)C_4H_9)COOCH_2CH(C_2H_5)C_4H_9$
W-4
$C_8H_{17}{-}C_6H_4{-}(OCH_2CH_2)_3{-}SO_3Na$
W-5
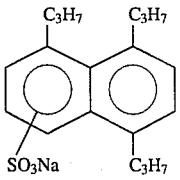
W-6
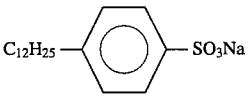
P-1
$\left(CH_2{-}CH(CONHC_4H_9(t))\right)_n$
M-1
$\left(CH_2{-}CH(COOC_4H_9)\right)_n$
F-1
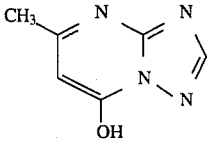
F-2
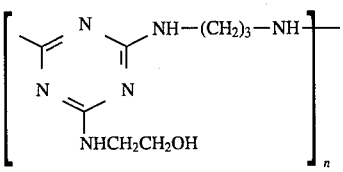
$\cdot HNO_3$
F-3
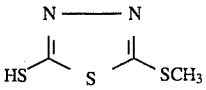
F-4
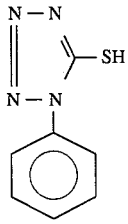

-continued

F-5

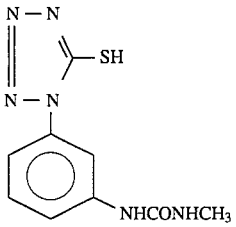

F-6

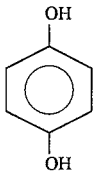

F-7

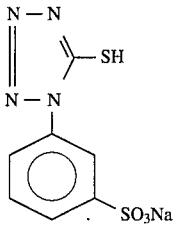

F-8

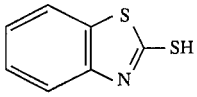

S-1

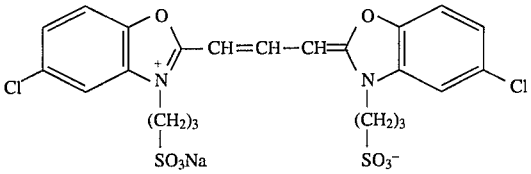

S-2

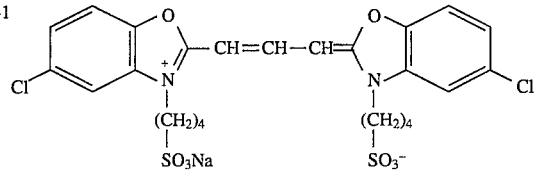

S-3

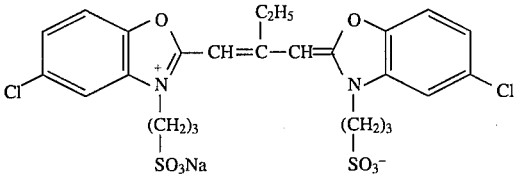

S-4

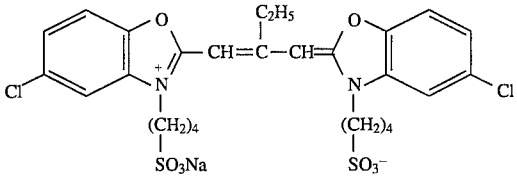

S-5

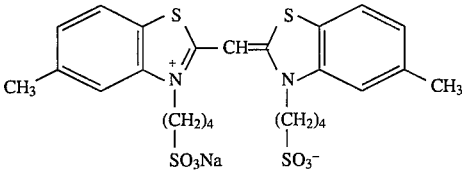

S-6

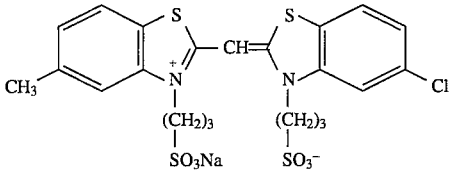

S-7

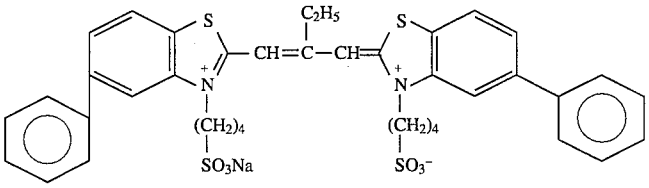

S-8

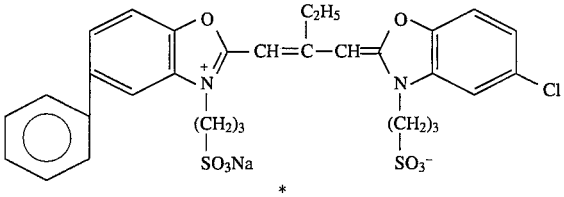

*

Preparation of Sample Nos. 202 to 209

Sample Nos. 202 to 209 were prepared in the same manner as in the preparation of Sample No. 201 except that the sensitizing dyes shown in Table 6 below were used in place of Sensitizing Dye S-3 used in each of the emulsions E to G.

The thus-obtained samples were exposed to white light through a gray wedge. The exposure time was 1/100 sec, and the exposure amount was 20 CMS. The samples were then processed in the following processing stages shown in Table 7 below, and sensitometry was carried out.

TABLE 6

| Sample No. | Sensitizing Dye of Emulsion E (0.5 g/mol of Ag) | Sensitizing Dye of Emulsion F (0.3 g/mol of Ag) | Sensitizing Dye of Emulsion G (0.25 g/mol of Ag) |
|---|---|---|---|
| 201 | S-3 | S-3 | S-3 |
| 202 | Dye C* | Dye C | Dye C |
| 203 | I-1 | I-1 | I-1 |
| 204 | I-2 | I-2 | I-2 |
| 205 | I-6 | I-6 | I-6 |
| 206 | I-29 | I-29 | I-29 |
| 207 | II-1 | II-1 | II-1 |
| 208 | II-4 | II-4 | II-4 |
| 209 | II-11 | II-11 | II-11 |

*Dye C:

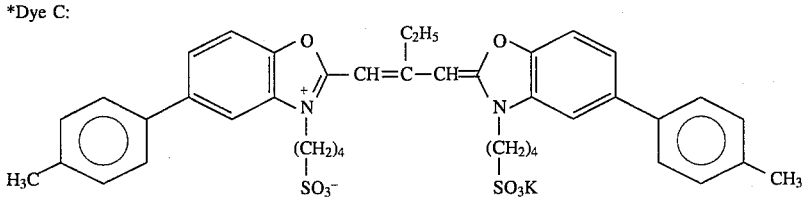

TABLE 7

| Processing Stage | Time | Temperature |
|---|---|---|
| First Development | 6 min | 38° C. |
| Rinsing | 2 min | 38° C. |
| Reversal | 2 min | 38° C. |
| Color Development | 6 min | 38° C. |
| Compensating | 2 min | 38° C. |
| Bleaching | 6 min | 38° C. |
| Fixing | 4 min | 38° C. |
| Rinsing | 4 min | 38° C. |
| Stabilization | 1 min | 25° C. |

Each processing solution had the following composition.

| First Developing Solution: | |
|---|---|
| Pentasodium Salt of Nitrilo-N,N,N-trimethylenephosphonate | 2.0 g |
| Sodium Sulfite | 30 g |
| Potassium Hydroquinonemonosulfonate | 20 g |
| Potassium Carbonate | 33 g |
| 1-Phenyl-4-methyl-4-hydroxymethyl-3-pyrazolidone | 2.0 g |
| Potassium Bromide | 2.5 g |
| Potassium Thiocyanate | 1.2 g |
| Potassium Iodide | 2.0 mg |
| Water to make | 1,000 ml |
| pH | 9.60 |

The pH was adjusted with hydrochloric acid or potassium hydroxide.

| Reversal Solution: | |
|---|---|
| Pentasodium Salt of Nitrilo-N,N,N-trimethylenephosphonate | 3.0 g |
| Stannous Chloride Dihydrate | 1.0 g |
| p-Aminophenol | 0.1 g |
| Sodium Hydroxide | 8 g |
| Glacial Acetic Acid | 15 ml |
| Water to make | 1,000 ml |
| pH | 6.00 |

The pH was adjusted with hydrochloric acid or potassium hydroxide.

| Color Developing Solution: | |
|---|---|
| Pentasodium Salt of Nitrilo-N,N,N-trimethylenephosphonate | 2.0 g |
| Sodium Sulfite | 7.0 g |
| Trisodium Phosphate Dodecahydrate | 36 g |
| Potassium Bromide | 1.0 g |
| Potassium Iodide | 90 mg |
| Sodium Hydroxide | 3.0 g |
| Citrazinic Acid | 1.5 g |
| N-Ethyl-(β-methanesulfonamidoethyl)-3-methyl-4-aminoaniline Sulfate | 11 g |
| 3,6-Dithiaoctane-1,8-diol | 1.0 g |
| Water to make | 1,000 ml |
| pH | 11.80 |

The pH was adjusted with hydrochloric acid or potassium hydroxide.

| Compensating Solution: | |
|---|---|
| Disodium Ethylenediaminetetraacetate Dihydrate | 8.0 g |
| Sodium Sulfite | 12 g |
| 1-Thioglycerin | 0.4 ml |
| Water to make | 1,000 ml |
| pH | 6.20 |

The pH was adjusted with hydrochloric acid or potassium hydroxide.

| Bleaching Solution: | |
|---|---|
| Disodium Ethylenediaminetetraacetate Dihydrate | 2.0 g |
| Ammonium Ethylenediaminetetraacetato Ferrate Dihydrate | 120 g |
| Potassium Bromide | 100 g |
| Ammonium Nitrate | 10 g |
| Water to make | 1,000 ml |
| pH | 5.70 |

The pH was adjusted with hydrochloric acid or sodium hydroxide.

| Fixing Solution: | |
|---|---|
| Ammonium Thiosulfate | 80 g |
| Sodium Sulfite | 5.0 g |
| Sodium Bisulfite | 5.0 g |
| Water to make | 1,000 ml |
| pH | 6.60 |

The pH was adjusted with hydrochloric acid or ammonia water.

| Stabilizing Solution: | |
|---|---|
| Formalin (37%) | 5.0 ml |
| Polyoxyethylene p-Monononylphenyl Ether (average degree of polymerization of 10) | 0.5 ml |
| Water to make | 1,000 ml |
| pH | not adjusted |

Sensitometry and residual color were evaluated. The results obtained are shown in Table 8 below. The relative sensitivity is based on the relative exposure amount which provides a density higher by 1.0 than the minimum density.

TABLE 8

| Sample No. | GL, Fresh Relative Sensitivity | Relative Sensitivity after Storage at 50° C. and 80% RH for 3 days | Remarks |
|---|---|---|---|
| 201 | 100 | 72 | Comparison |
| 202 | 90 | 55 | Comparison |
| 203 | 105 | 90 | Invention |
| 204 | 120 | 101 | Invention |
| 205 | 113 | 93 | Invention |
| 206 | 117 | 98 | Invention |
| 207 | 107 | 101 | Invention |
| 208 | 103 | 97 | Invention |
| 209 | 111 | 100 | Invention |

As is apparent from the results shown in Table 8, when the compounds and emulsions according to the present invention are used, there can be obtained the photographic materials which have high GL sensitivity and cause hardly a lowering in sensitivity with the passage of time.

EXAMPLE 3

The following layers having the following compositions were coated on an undercoated cellulose triacetate film to prepare a multi-layer color photographic material as Sample No. 301.

Composition of Light-Sensitive Layer

The coating weights of the silver halide emulsions and colloidal silver are represented by g/m$^2$ in terms of silver. The amounts of the couplers, the additives and gelatin are represented by coating weights (g/m$^2$). The amounts of the sensitizing dyes are represented by moles per one mole of silver halide in the same layer.

| First Layer (antihalation layer): | |
|---|---|
| Black Colloidal Silver | 0.15 |
| Gelatin | 1.90 |
| ExM-1 | $5.0 \times 10^{-3}$ |
| **Second Layer (interlayer):** | |
| Gelatin | 2.10 |
| UV-1 | $3.0 \times 10^{-2}$ |
| UV-2 | $6.0 \times 10^{-2}$ |
| UV-3 | $7.0 \times 10^{-2}$ |
| ExF-1 | $4.0 \times 10^{-3}$ |
| Solv-2 | $7.0 \times 10^{-2}$ |
| **Third Layer (low-sensitivity red-sensitive emulsion layer):** | |
| Silver Iodobromide Emulsion (in terms of silver) (AgI content: 2 mol %; interior high AgI type; grain size in terms of the diameter of the corresponding sphere: 0.3 μm; a coefficient of variation in grain size distribution in terms of the diameter of the corresponding sphere: 29%; a mixture of regular grains and twin grains; the ratio of diameter/thickness: 2.5) | 0.50 |
| Gelatin | 1.50 |
| ExS-10 | $4.1 \times 10^{-4}$ |
| ExC-1 | 0.11 |
| ExC-3 | 0.11 |
| ExC-4 | $3.0 \times 10^{-2}$ |
| ExC-7 | $1.0 \times 10^{-2}$ |
| Solv-1 | $7.0 \times 10^{-3}$ |
| **Fourth Layer (intermediate-sensitivity red-sensitive emulsion layer):** | |
| Silver Iodobromide Emulsion | 0.85 |

| | |
|---|---|
| (in terms of silver) (AgI content: 4 mol %; interior high AgI type; grain size in terms of the diameter of the corresponding sphere: 0.55 μm; a coefficient of variation in grain size distribution in terms of the diameter of the corresponding sphere: 20%; a mixture of regular grains and twin grains; the ratio of diameter/thickness: 1.0) | |
| Gelatin | 2.00 |
| ExS-10 | $4.1 \times 10^{-4}$ |
| ExC-1 | 0.16 |
| ExC-2 | $8.0 \times 10^{-2}$ |
| ExC-3 | 0.17 |
| ExC-7 | $1.5 \times 10^{-2}$ |
| ExY-1 | $2.0 \times 10^{-2}$ |
| ExY-2 | $1.0 \times 10^{-2}$ |
| Cpd-10 | $1.0 \times 10^{-4}$ |
| Solv-1 | 0.10 |
| Fifth Layer (high-sensitivity red-sensitive emulsion layer): | |
| Silver Iodobromide Emulsion (in terms of silver) (AgI content: 10 mol %; interior high AgI type; grain size in terms of the diameter of the corresponding sphere: 0.7 μm; a coefficient of variation in grain size distribution in terms of the diameter of the corresponding sphere: 30%; a mixture of regular grains and twin grains; the ratio of diameter/thickness: 2.0) | 0.70 |
| Gelatin | 1.60 |
| ExS-10 | $4.1 \times 10^{-4}$ |
| ExC-5 | $7.0 \times 10^{-2}$ |
| ExC-6 | $8.0 \times 10^{-2}$ |
| ExC-7 | $1.5 \times 10^{-2}$ |
| Solv-1 | 0.15 |
| Solv-2 | $8.0 \times 10^{-2}$ |
| Sixth Layer (interlayer): | |
| Gelatin | 1.10 |
| P-2 | 0.17 |
| Cpd-1 | 0.10 |
| Cpd-4 | 0.17 |
| Solv-1 | $5.0 \times 10^{-2}$ |
| Seventh Layer (low-sensitivity green-sensitive emulsion layer): | |
| Silver Iodobromide Emulsion (in terms of silver) (AgI content: 2 mol %; interior high AgI type; grain size-in terms of the diameter of the corresponding sphere: 0.3 μm; a coefficient of variation in grain size distribution in terms of the diameter of the corresponding sphere: 28%; a mixture of regular grains and twin grains; the ratio of diameter/thickness: 2.5) | 0.30 |
| Gelatin | 0.50 |
| ExS-1 | $5.0 \times 10^{-4}$ |
| ExS-5 | $2.0 \times 10^{-4}$ |
| ExS-2 | $0.3 \times 10^{-4}$ |
| ExM-1 | $3.0 \times 10^{-2}$ |
| ExM-2 | 0.20 |
| ExY-1 | $3.0 \times 10^{-2}$ |
| Cpd-11 | $7.0 \times 10^{-3}$ |
| Solv-1 | 0.20 |
| Eighth Layer (intermediate-sensitivity green-sensitive emulsion layer): | |
| Silver Iodobromide Emulsion (in terms of silver) (AgI content: 4 mol %; interior high AgI type; grain size in terms of the diameter of the corresponding sphere: 0.55 μm; a coefficient of variation in grain size distribution in terms of the diameter of the corresponding sphere: 20%; a mixture of regular grains and twin grains; | 0.70 |

| | |
|---|---|
| the ratio of diameter/thickness: 4.0) | |
| Gelatin | 1.00 |
| ExS-1 | $5.0 \times 10^{-4}$ |
| ExS-5 | $2.0 \times 10^{-4}$ |
| ExS-2 | $3.0 \times 10^{-5}$ |
| ExM-1 | $3.0 \times 10^{-2}$ |
| ExM-2 | 0.25 |
| ExM-3 | $1.5 \times 10^{-2}$ |
| ExY-1 | $4.0 \times 10^{-2}$ |
| Cpd-11 | $9.0 \times 10^{-3}$ |
| Solv-1 | 0.20 |
| Ninth Layer (high-sensitivity green-sensitive emulsion layer) | |
| Silver Iodobromide Emulsion (in terms of silver) (AgI content: 10 mol %; interior high AgI type; grain size in terms of the diameter of the corresponding sphere: 0.7 μm; a coefficient of variation in grain size distribution in terms of the diameter of the corresponding sphere: 30%; a mixture of regular grains and twin grains; the ratio of diameter/thickness: 2.0) | 0.50 |
| Gelatin | 0.90 |
| ExS-1 | $2.0 \times 10^{-4}$ |
| ExS-5 | $2.0 \times 10^{-4}$ |
| ExS-2 | $2.0 \times 10^{-5}$ |
| ExS-7 | $3.0 \times 10^{-4}$ |
| ExM-1 | $1.0 \times 10^{-2}$ |
| ExM-4 | $3.9 \times 10^{-2}$ |
| ExM-5 | $2.6 \times 10^{-2}$ |
| Cpd-2 | $1.0 \times 10^{-2}$ |
| Cpd-9 | $1.0 \times 10^{-4}$ |
| Cpd-10 | $2.0 \times 10^{-4}$ |
| Solv-1 | 0.20 |
| Solv-2 | $5.0 \times 10^{-2}$ |
| Tenth Layer (yellow filter layer): | |
| Gelatin | 0.90 |
| Yellow Colloidal Silver | $5.0 \times 10^{-2}$ |
| Cpd-1 | 0.20 |
| Solv-1 | 0.15 |
| Eleventh Layer (low-sensitivity blue-sensitive emulsion layer): | |
| Silver Iodobromide Emulsion (in terms of silver) (AgI content: 4 mol %; interior high AgI type; grain size in terms of the diameter of the corresponding sphere: 0.55 μm; a coefficient of variation in grain size distribution in terms of the diameter of the corresponding sphere: 15%; octahedral grains) | 0.40 |
| Gelatin | 1.00 |
| ExS-4 | $2.0 \times 10^{-4}$ |
| ExY-1 | $9.0 \times 10^{-2}$ |
| ExY-3 | 0.90 |
| Cpd-2 | $1.0 \times 10^{-2}$ |
| Solv-1 | 0.30 |
| Twelfth Layer (high-sensitivity blue-sensitive emulsion layer): | |
| Silver Iodobromide Emulsion (in terms of silver) (AgI content: 10 mol %; interior high AgI type; grain size in terms of the diameter of the corresponding sphere: 1.3 μm; a coefficient of variation in grain size distribution in terms of the diameter of the corresponding sphere: 25%; a mixture of regular grains and twin grains; the ratio of diameter/thickness: 4.5) | 0.50 |
| Gelatin | 0.60 |
| ExS-4 | $1.0 \times 10^{-4}$ |
| ExY-3 | 0.12 |
| Cpd-2 | $1.0 \times 10^{-3}$ |
| Solv-1 | $4.0 \times 10^{-2}$ |
| Thirteenth Layer (first protective layer): | |

| | |
|---|---|
| Fine Grains of Silver Iodobromide (mean grain size: 0.07 μm; AgI content; 1 mol %) | 0.20 |
| Gelatin | 0.80 |
| UV-2 | 0.10 |
| UV-3 | 0.10 |
| UV-4 | 0.20 |
| Solv-3 | $4.0 \times 10^{-2}$ |
| P-2 | $9.0 \times 10^{-2}$ |
| Fourteenth Layer (second protective layer): | |
| Gelatin | 0.90 |
| B-1 (diameter: 1.5 μm) | 0.10 |
| B-2 (diameter: 1.5 μm) | 0.10 |
| B-3 | $2.0 \times 10^{-2}$ |

| | |
|---|---|
| H-1 | 0.40 |

Further, the following compounds Cpd-3, Cpd-5, Cpd-6, Cpd-7, Cpd-8, P-1, W-1, W-2 and W-3 were added to improve preservability, processability, pressure resistance, antimicrobial and antifungal properties, antistatic properties and coatability.

In addition thereto, n-butyl-p-hydroxybenzoate was added. Furthermore, B-4, F-1, F-4, F-5, F-6, F-7, F-8, F-9, F-10, F-11, an iron salt, a lead salt, a gold salt, a platinum salt, an iridium salt and a rhodium salt were contained.

The chemical structural formulae and chemical names of the compounds used in Example 3 are shown below.

UV-1

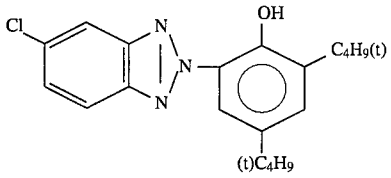

UV-2

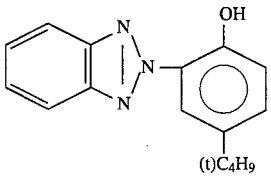

UV-3

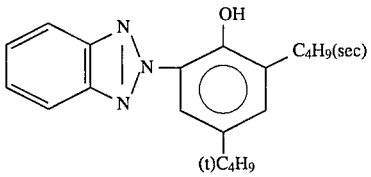

UV-4

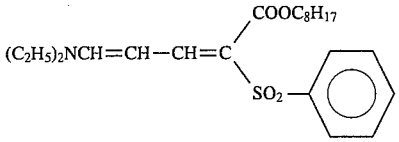

Tricresyl Phosphate Solv-1

Dibutyl Phthalate Solv-2

Tri(2-ethylhexyl) Phthalate Solv-3

ExF-1

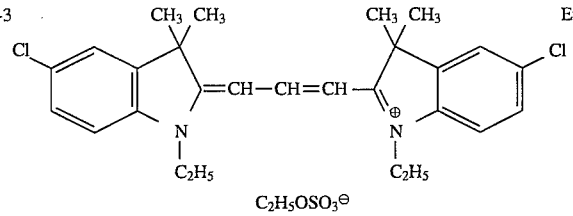

ExC-1

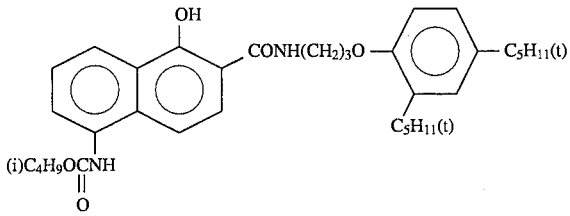

ExC-2

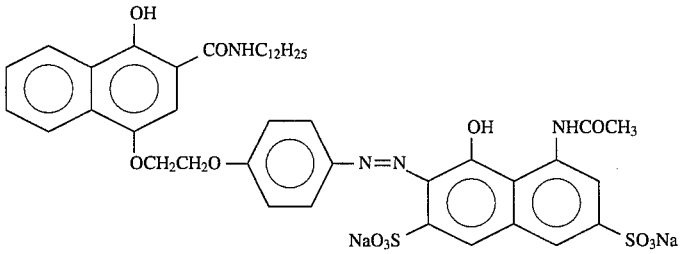

-continued
ExC-3
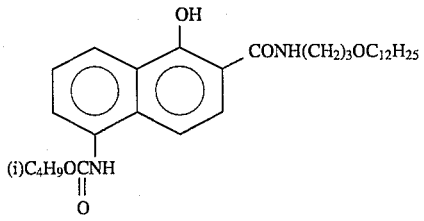
ExC-4
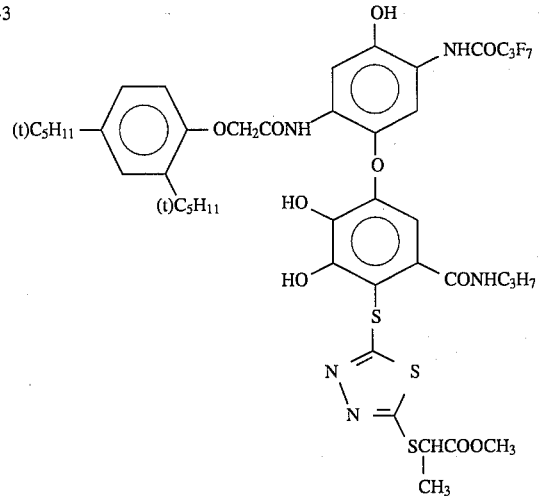
ExC-5
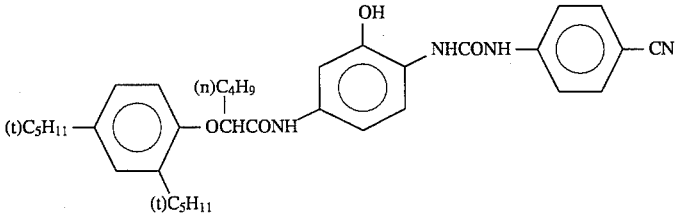
ExC-6
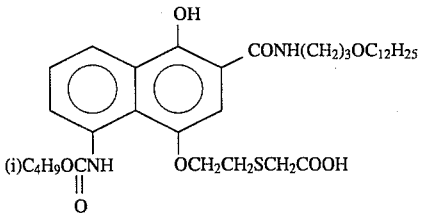
ExC-7
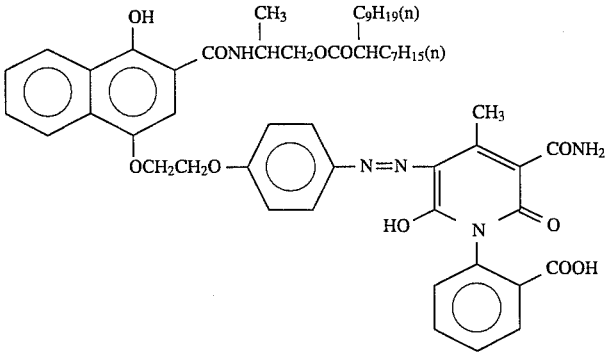
ExM-1
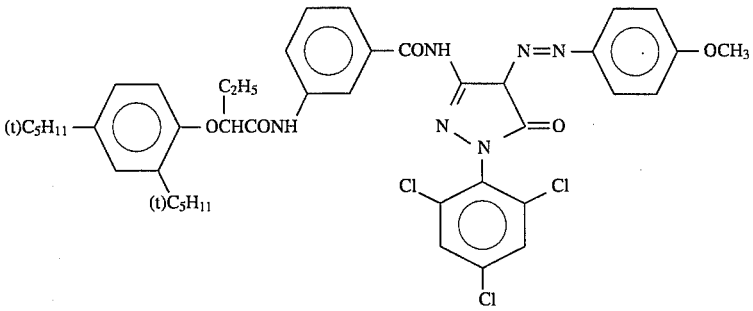

-continued
ExM-2
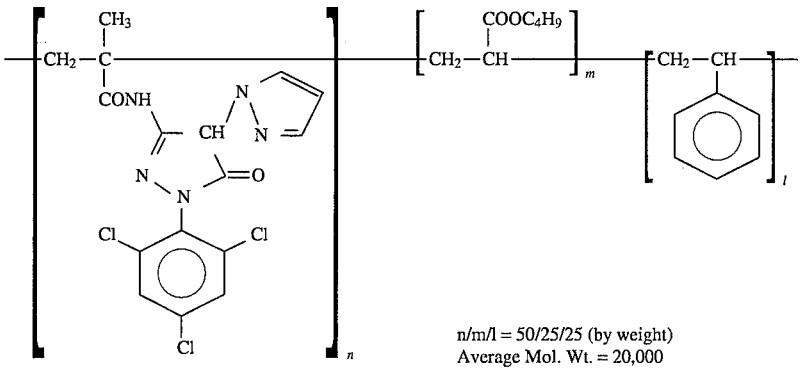
n/m/l = 50/25/25 (by weight)
Average Mol. Wt. = 20,000
ExM-3
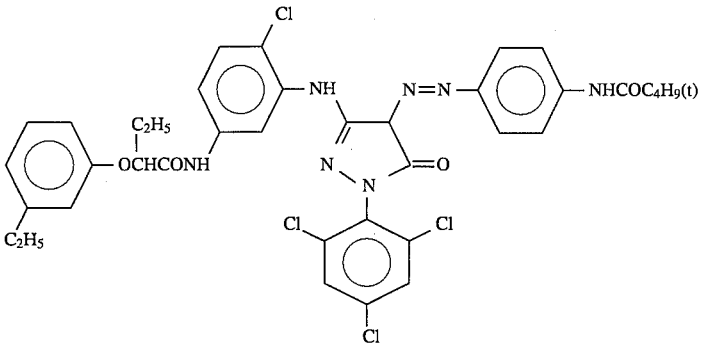
ExM-4
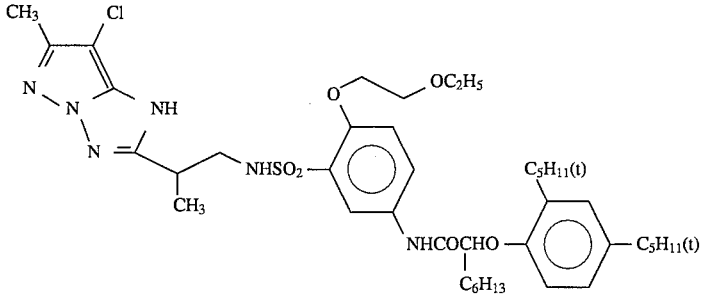
ExM-5
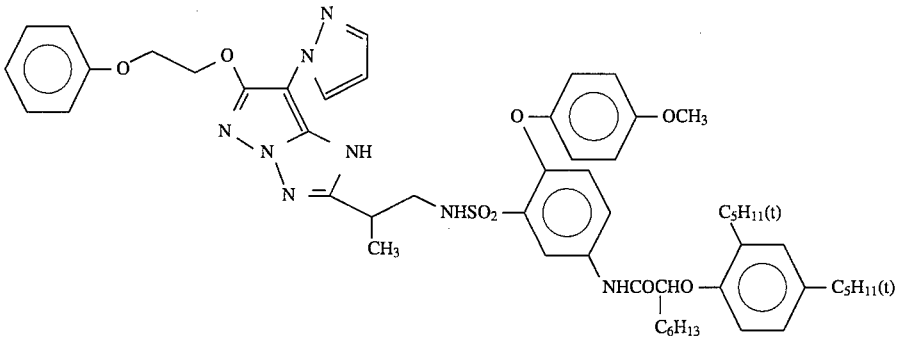
ExY-1
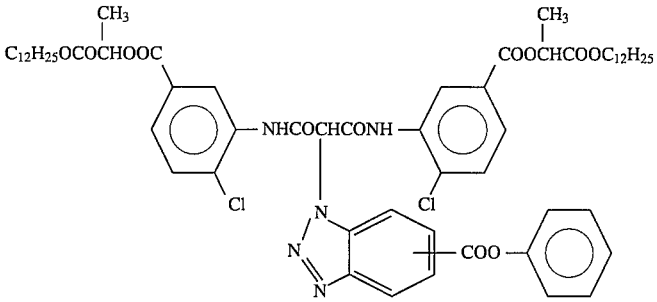

-continued
ExY-2
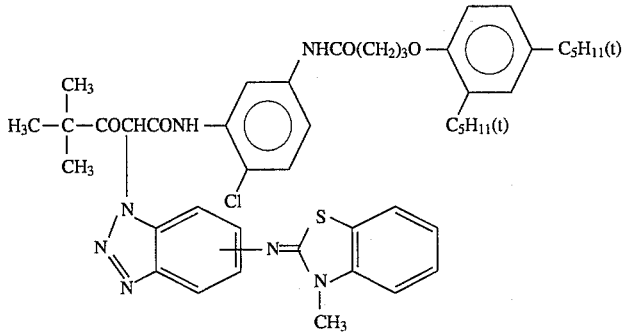
ExY-3
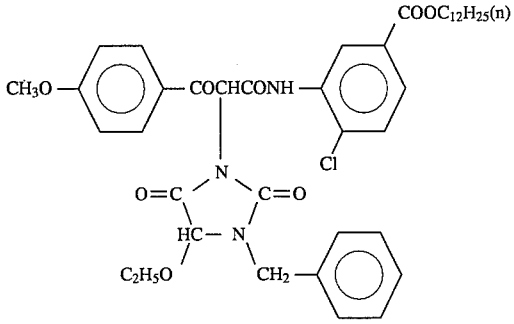
Cpd-1
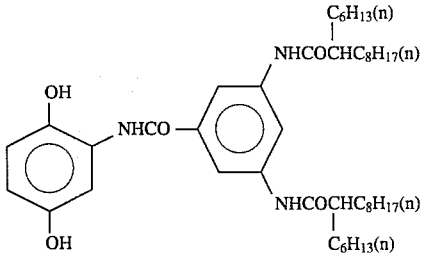
Cpd-2
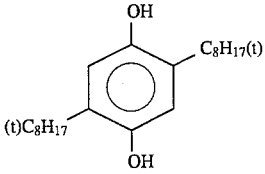
Cpd-3
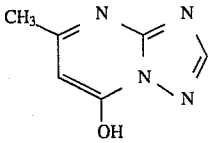
Cpd-4
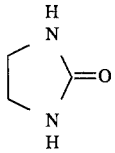
Cpd-5
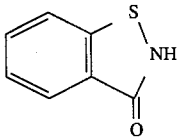
Cpd-6
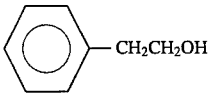
Cpd-7
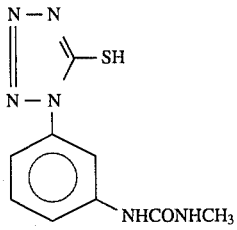
Cpd-8
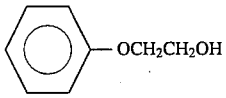

-continued
Cpd-9
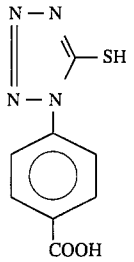
Cpd-10
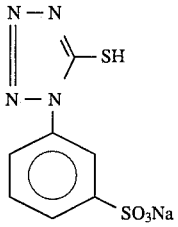
Cpd-11
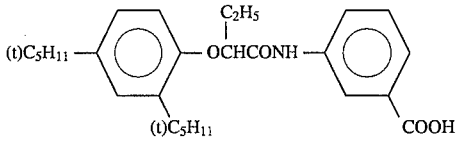
ExS-1
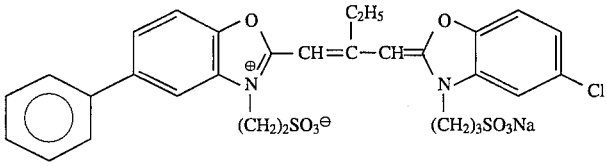
ExS-2
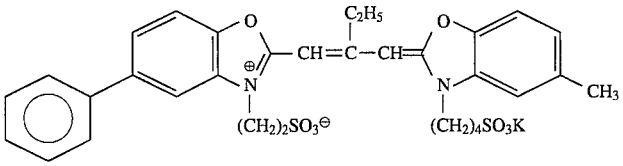
ExS-3
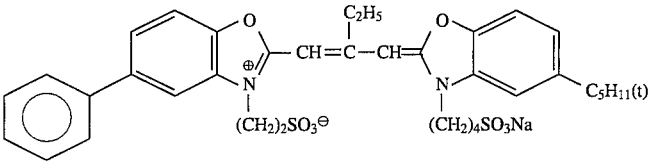
ExS-4
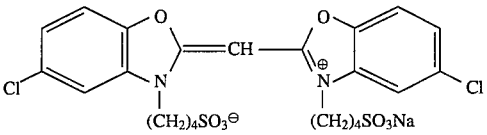
ExS-5
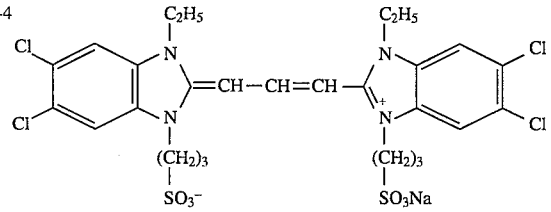
ExS-6
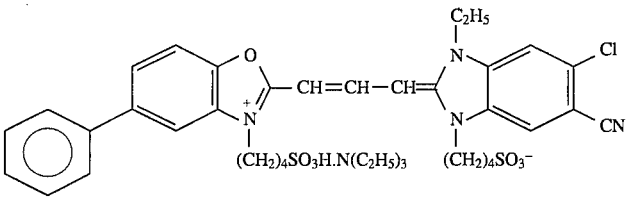
ExS-7
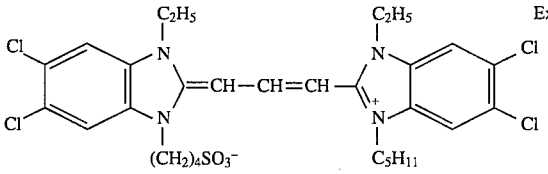
ExS-8
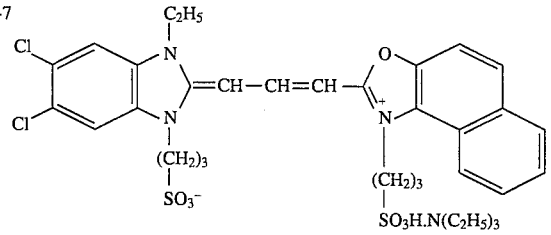

-continued
ExS-9
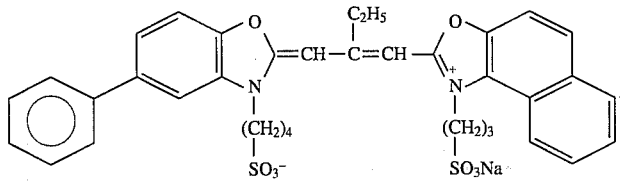
ExS-10
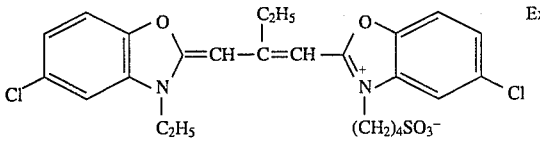
B-1
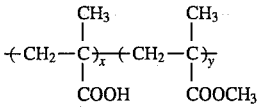
x/y = 10/90
B-2
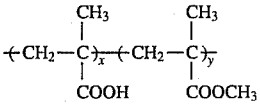
x/y = 40/60
B-3
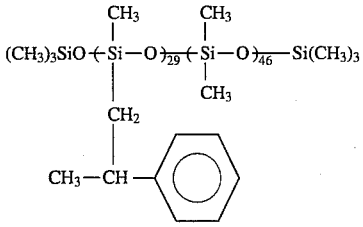
B-4
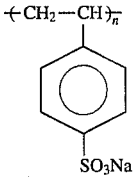
H-1
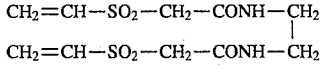
W-1
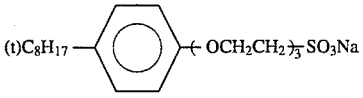
W-2
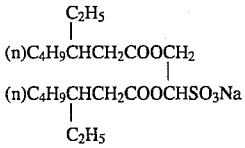
$C_8F_{17}SO_2N(C_3H_7)CH_2COOK$
W-3
Vinyl Pyrrolidone/Vinyl Alcohol Copolymer (70:30 by weight)
P-1
Polyethyl Acrylate
P-2
F-1
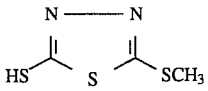
F-4
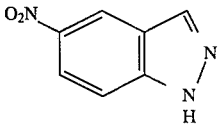
F-5
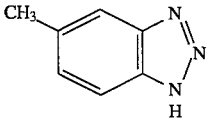
F-6
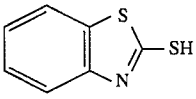
F-7
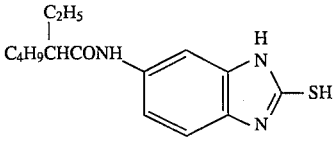
F-8
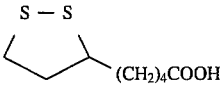
F-9
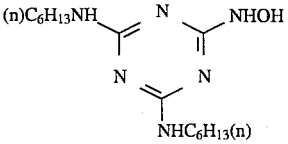
F-10
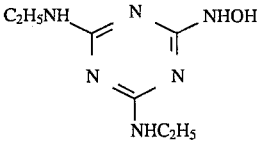
F-11
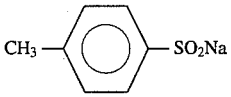

Preparation of Sample Nos 302 to 310

Sample Nos. 302 to 310 were prepared in the same manner as in the preparation of Sample 301 except that sensitizing dyes shown in Table 9 below were used in place of ExS-10 used in Sample No. 301.

TABLE 9

| Sample No. | Sensitizing Dye ($4.1 \times 10^{-4}$ mol/mol of Ag) | Remarks |
|---|---|---|
| 301 | ExS-10 | Comparison |
| 302 | Dye B* | Comparison |
| 303 | I-7 | Invention |
| 304 | I-9 | Invention |
| 305 | I-14 | Invention |
| 306 | I-26 | Invention |
| 307 | I-31 | Invention |
| 308 | II-1 | Invention |
| 309 | II-5 | Invention |
| 310 | II-16 | Invention |

*Dye B is the same as in Example 1.

Sample Nos. 301 to 310 were exposed through a white wedge. The exposure time was 1/100 sec, and the exposure amount was 50 CMS. The samples were processed in the following processing stages shown in Table 10 below, and sensitometry was carried out.

It was found that the samples of the present invention had high green sensitivity and excellent preservability as in Example 2.

TABLE 10

| Processing Method | | | | |
|---|---|---|---|---|
| Stage | Processing Time | Processing Temperature (°C.) | Replenishment Rate (ml) | Tank Capacity (l) |
| Color Development | 3 min 15 sec | 37.8 | 25 | 10 |
| Bleaching | 45 sec | 38 | 5 | 4 |
| Bleaching-Fixing (1) | 45 sec | 38 | — | 4 |
| Bleaching-Fixing (2) | 45 sec | 38 | 30 | 4 |
| Rinsing (1) | 20 sec | 38 | — | 2 |
| Rinsing (2) | 20 sec | 38 | 30 | 2 |
| Stabilization | 20 sec | 38 | 20 | 2 |
| Drying | 1 min | 55 | | |

*The replenishment rate being per 1 m long by 35 mm wide.

The bleaching-fixing stage and the rinsing stage were carried out by the countercurrent system of from (2) to (1). All of the overflow solution of the bleaching solution was introduced into the bleaching-fixing stage (2).

The amount of the bleaching-fixing solution brought over into the rinsing stage in the above processing was 2 ml per 1 meter of the photographic material of 35 mm in width.

The processing solutions had the following compositions:

| | Mother Solution (g) | Replenisher (g) |
|---|---|---|
| Color Developing Solution: | | |
| Diethylenetriamine-pentaacetic Acid | 5.0 | 6.0 |
| Sodium Sulfite | 4.0 | 5.0 |
| Potassium Carbonate | 30.0 | 37.0 |
| Potassium Bromide | 1.3 | 0.5 |
| Potassium Iodide | 1.2 mg | — |
| Hydroxylamine Sulfate | 2.0 | 3.6 |
| 4-[N-Ethyl-N-β-hydroxyethyl-amino]-2-methylaniline Sulfate | 4.7 | 6.2 |
| Water to make | 1.0 l | 1.0 l |
| pH | 10.00 | 10.15 |
| Bleaching Solution: | | |
| Ammonium 1,3-Diaminopropane-tetraacetato Ferrate Monohydrate | 144.0 | 206.0 |
| 1,3-Diaminopropanetetraacetic Acid | 2.8 | 4.0 |
| Ammonium Bromide | 84.0 | 120.0 |
| Ammonium Nitrate | 17.5 | 25.0 |
| Ammonia Water (27%) | 10.0 | 1.8 |
| Acetic Acid (98%) | 51.1 | 73.0 |
| Water to make | 1.0 l | 1.0 l |
| pH | 4.3 | 3.4 |
| Bleaching-Fixing Solution: | | |
| Ammonium Ethylenediamine-tetraacetato Ferrate Dihydrate | 50.0 | — |
| Disodium Ethylenediamine-tetraacetate | 5.0 | 25.0 |
| Ammonium Sulfite | 12.0 | 20.0 |
| Aqueous Solution of Ammonium Thiosulfate (700 g/liter) | 290 ml | 320 ml |
| Ammonia Water (27%) | 6.0 ml | 15.0 ml |
| Water to make | 1.0 l | 1.0 l |
| pH | 6.8 | 8.0 |

Rinsing Solution:

Mother solution and replenisher being the same.

Tap water was passed through a mixed bed column packed with an H type strongly acidic cation exchange resin (Amberlite IR-120B, a product of Rohm & Haas Co.) and an OH type anion exchange resin (Amberlite IR-400) to reduce the concentration of each of calcium ion and magnesium ion to 3 mg/liter or less. Subsequently, sodium dichloroisocyanurate (20 mg/liter) and sodium sulfate (150 mg/liter) were added thereto. The pH of the solution was from 6.5 to 7.5.

| Stabilizing Solution<br>Mother solution and replenisher being the same. | |
|---|---|
| Formalin (37%) | 1.2 ml |
| Surfactant [$C_{10}H_{21}$—O—$(CH_2CH_2O)_{10}$—H] | 0.4 g |
| Ethylene Glycol | 1.0 g |
| Water to make | 1.0 l |
| pH | 5.0 to 7.0 |

EXAMPLE 4

Preparation of Sample No. 401

Both sides of a paper support were laminated with polyethylene. The following first to twelfth layers were coated on the resulting polyethylene-laminated support to prepare a multi-layer color photographic material. Polyethylene on the first layer-coated side contained 5% by weight of anatase type titanium oxide as a white pigment and a very small amount of ultramarine as a bluish dye.

Composition of Light-Sensitive Layer:

The amount of the ingredients are represented by coating weights (g/m$^2$). The amounts of the silver halides are represented by coating weights (g/m$^2$) in terms of silver.

| | |
|---|---|
| First Layer (gelatin layer): | 1.30 |
| Gelatin | |
| Second Layer (antihalation layer): | |
| Black Colloidal Silver | 0.10 |
| Gelatin | 0.70 |
| Third Layer (low-sensitivity red-sensitive layer): | |
| Silver Chloroiodobromide spectral-sensitized with red sensitizing dye (ExS-3) (silver chloride content: 1 mol %; silver iodide content: 4 mol %; mean grain size: 0.3 μm; grain size distribution: 10%; cubic; iodide core type core/shell grain) | 0.06 |
| Silver Iodobromide spectral-sensitized with red sensitizing dye (ExS-3) (silver iodide content: 4 mol %; mean grain size; 0.5 μm; grain size distribution: 15%; cubic) | 0.10 |
| Gelatin | 1.00 |
| Cyan Coupler (ExC-1) | 0.14 |
| Cyan Coupler (ExC-2) | 0.07 |
| Anti-Fading Agent (Cpd-2, 3, 4 in an equal amount ratio) | 0.12 |
| Dispersion Medium (Cpd-6) for Couplers | 0.03 |
| Solvent (Solv-1, 2, 3 in an equal amount ratio) for Couplers | 0.06 |
| Development Accelerator (Cpd-13) | 0.05 |
| Fourth Layer (high-sensitivity red-sensitive layer): | |
| Silver Iodobromide spectral-sensitized with red sensitizing dye (ExS-3) (silver iodide content: 6 mol %; mean grain size: 0.8 μm; grain size distribution: 20%; tabular grain (aspect ratio = 8; core iodide)) | 0.15 |
| Gelatin | 1.00 |
| Cyan Coupler (ExC-1) | 0.20 |
| Cyan Coupler (ExC-2) | 0.10 |
| Anti-Fading Agent (Cpd-2, 3, 4 in an equal amount ratio) | 0.15 |
| Dispersion Medium (Cpd-6) for Couplers | 0.03 |
| Solvent (Cpd-1, 2, 3 in an equal amount ratio) for Couplers | 0.10 |
| Fifth Layer (interlayer): | |
| Magenta Colloidal Silver | 0.02 |
| Gelatin | 1.00 |
| Anti-Fading Agent (Cpd-7, 16 in an equal amount ratio) | 0.08 |
| Solvent (Solv-4, 5 in an equal amount ratio) for Anti-Fading Agent | 0.16 |
| Polymer Latex (Cpd-8) | 0.10 |
| Sixth Layer (low-sensitivity green-sensitive layer): | |
| Silver Chloroiodobromide spectral-sensitized with green sensitizing dyes (ExS-1, 2) (silver chloride content: 1 mol %, silver iodide content: 2.5 mol %; mean grain size: 0.28 μm; grain size distribution: 8%; cubic; iodide core type core/shell grain) | 0.04 |
| Silver Iodobromide spectral-sensitized with green sensitizing dyes (ExS-1, 2) (silver iodide content: 2.5 mol %; mean grain size: 0.48 μm; grain size distribution: 12%; cubic) | 0.06 |
| Gelatin | 0.80 |
| Magenta Coupler (ExM-1, 2 in an equal amount ratio) | 0.10 |
| Anti-Fading Agent (Cpd-9) | 0.10 |

-continued

| | |
|---|---|
| Stain Inhibitor (Cpd-10 and 11 in an equal amount ratio) | 0.01 |
| Stain Inhibitor (Cpd-5) | 0.001 |
| Stain Inhibitor (Cpd-12) | 0.01 |
| Dispersion Medium (Cpd-6) | 0.05 |
| Solvent (Solv-4, 6 in an equal amount ratio) for Couplers | 0.15 |
| Seventh Layer (high-sensitivity green-sensitive layer): | |
| Silver Iodobromide spectral-sensitized with green sensitizing dyes (ExS-1, 2) (silver iodide content: 3.5 mol %, mean grain size: 1.0 μm; grain size distribution: 21%; tabular (aspect ratio = 9, uniform iodide type)) | 0.10 |
| Gelatin | 0.80 |
| Magenta Coupler (ExM-1, 2 in an equal amount ratio) | 0.10 |
| Anti-Fading Agent (Cpd-9) | 0.10 |
| Stain Inhibitor (Cpd-10, 11, 22 in an equal amount ratio) | 0.01 |
| Stain Inhibitor (Cpd-5) | 0.001 |
| Stain Inhibitor (Cpd-12) | 0.01 |
| Dispersion Medium (Cpd-6) for Couplers | 0.05 |
| Solvent (Solv-4, 6 in an equal amount ratio) for couplers | 0.15 |
| Eighth Layer (yellow-filter layer): | |
| Yellow Colloidal Silver | 0.20 |
| Gelatin | 1.00 |
| Anti-Fading Agent (Cpd-7) | 0.06 |
| Solvent (Solv-4, 5 in an equal amount ratio) for Anti-Fading Agent | 0.15 |
| Polymer Latex (Cpd-8) | 0.10 |
| Ninth Layer (low-sensitivity blue-sensitive layer): | |
| Silver Chloroiodobromide spectral-sensitized with blue sensitizing dyes (ExS-4, 5) (silver chloride content: 2 mol %, silver iodide content: 2.5 mol %, mean grain size: 0.38 μm; grain size distribution: 8%; cubic; iodide core type core/shell grain) | 0.07 |
| Silver Iodobromide spectral-sensitized with blue sensitizing dyes (ExS-4, 5) (silver iodide content: 2.5 mol %, mean grain size: 0.55 μm; grain size distribution: 11%; cubic) | 0.10 |
| Gelatin | 0.50 |
| Yellow Coupler (ExY-1, 2 in an equal amount ratio) | 0.20 |
| Stain Inhibitor (Cpd-5) | 0.001 |
| Anti-Fading Agent (Cpd-14) | 0.10 |
| Dispersion Medium (Cpd-6) for Couplers | 0.05 |
| Solvent (Solv-2) for Couplers | 0.05 |
| Tenth Layer (high-sensitivity blue-sensitive layer): | |
| Silver Iodobromide spectral-sensitized with blue sensitizing dyes (ExS-4, 5) (silver iodide content: 2.5 mol %, mean grain size: 1.4 μm; grain size distribution: 21%; tabular, aspect ratio = 14) | 0.25 |
| Gelatin | 1.00 |
| Yellow Coupler (ExY-1, 2 in an equal amount ratio) | 0.40 |
| Stain Inhibitor (Cpd-5) | 0.002 |
| Anti-Fading Agent (Cpd-14) | 0.10 |
| Dispersion Medium (Cpd-6) for Couplers | 0.15 |
| Solvent (Solv-2) for Couplers | 0.10 |
| Eleventh Layer (ultraviolet light absorbing layer): | |
| Gelatin | 1.50 |
| Ultraviolet Light Absorber (Cpd-1, 2, 4, 15 in an equal amount ratio) | 1.00 |

| | |
|---|---|
| Anti-Fading Agent (Cpd-7, 16) | 0.06 |
| Dispersion Medium (Cpd-6) | 0.10 |
| Solvent (Solv-1, 2) for Ultraviolet Light Absorber | 0.15 |
| Irradiation Preventing Dye (Cpd-17, 18) | 0.02 |
| Irradiation Preventing Dye (Cpd-19, 20) | 0.02 |
| Twelfth Layer (protective layer): | |
| Fine Grains of Silver Chlorobromide (silver chloride content: 97 mol %; mean grain size: 0.2 μm) | 0.07 |
| Modified Poval | 0.02 |
| Gelatin | 1.50 |

| | |
|---|---|
| Hardening Agent (H-1, 2 in an equal amount ratio) for Gelatin | 0.17 |

Further, each layer contained Alkanol XC (produced by Du Pont) and sodium alkylbenzenesulfonate as emulsifying dispersion aids, and succinic ester and Magefac F-120 (produced by Dainippon Ink & Chemicals, Inc.) as coating aids. The layers containing silver halide or colloidal silver contained Cpd-21, Cpd-22 and Cpd-23. The compounds used in Example 4 are shown below.

ExS-1

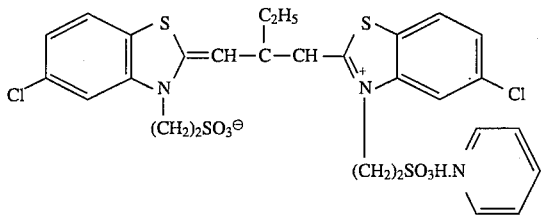

ExS-2

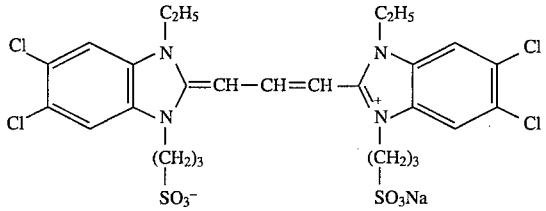

ExS-3

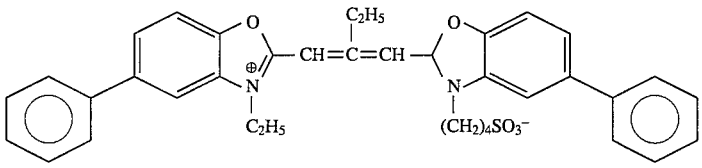

ExS-4

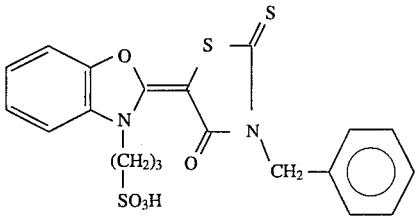

ExS-5

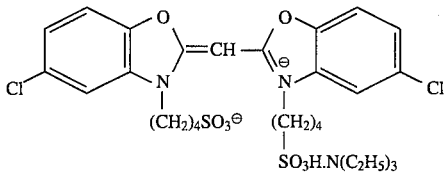

Cpd-1

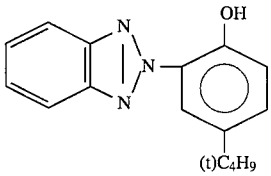

-continued
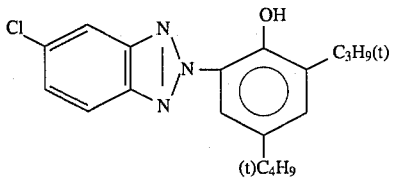
Cpd-2
Di(3-methylhexyl) Phthalate — Solv-3
Tricresyl Phosphate — Solv-4
Dibutyl Phthalate — Solv-5
Trioctyl Phosphate — Solv-6
$CH_2{=}CH{-}SO_2{-}CH_2{-}CONH{-}CH_2$
$CH_2{=}CH{-}SO_2{-}CH_2{-}CONH{-}CH_2$ — H-1
Na Salt of 4,6-Dichloro-2-hydroxy-1,3,5-triazine — H-2
ExY-1
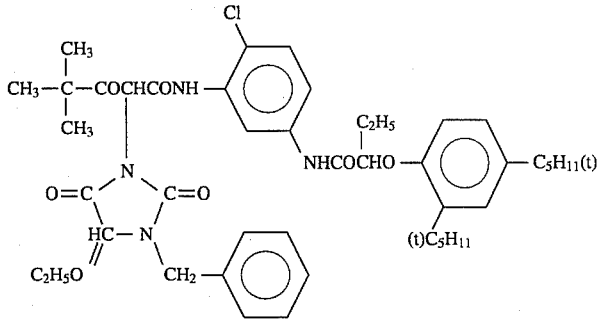
ExY-2
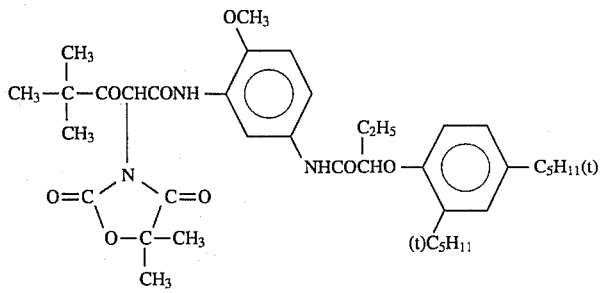
Di(2-ethylhexyl) Phthalate — Solv-1
Trinonyl Phosphate — Solv-2
ExC-2
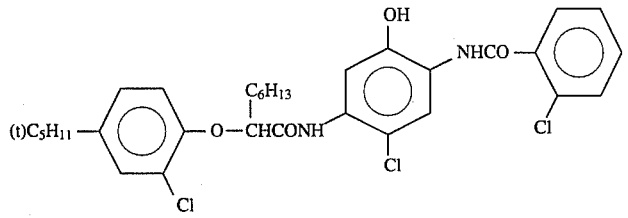

-continued
ExM-1
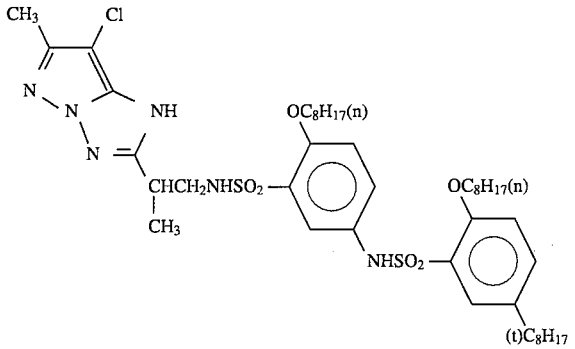
ExM-2
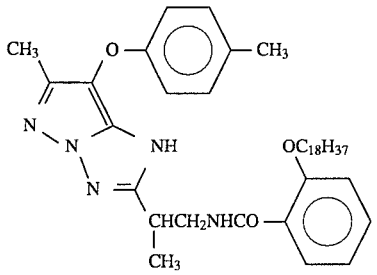
Cpd-21
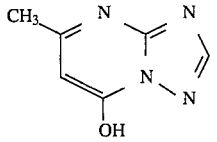
Cpd-22
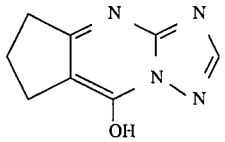
Cpd-23
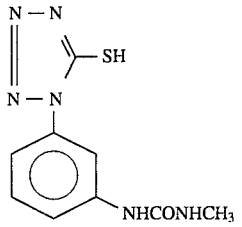
ExC-1
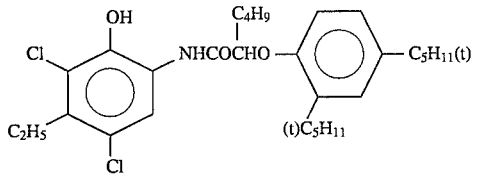
Cpd-17
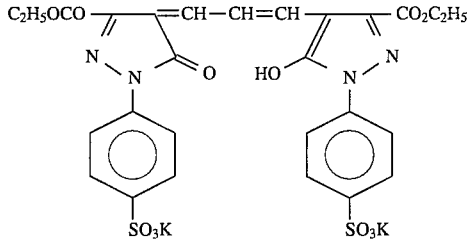

-continued
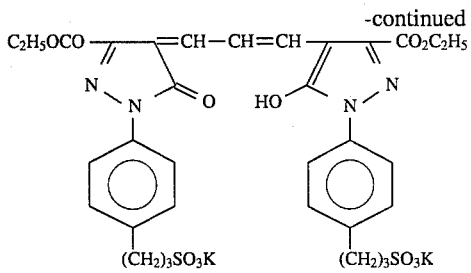
Cpd-18
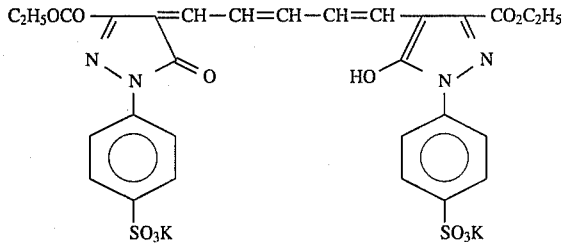
Cpd-19
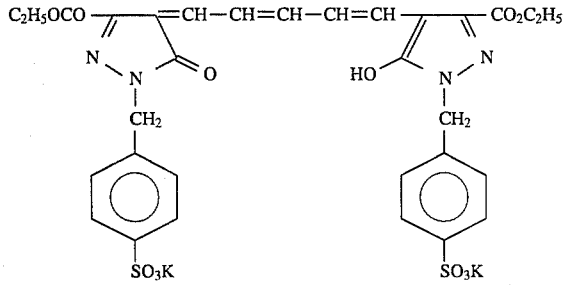
Cpd-20
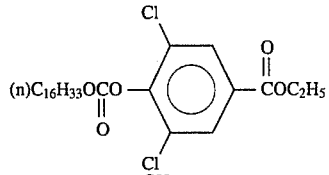
Cpd-12
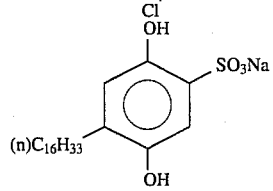
Cpd-13
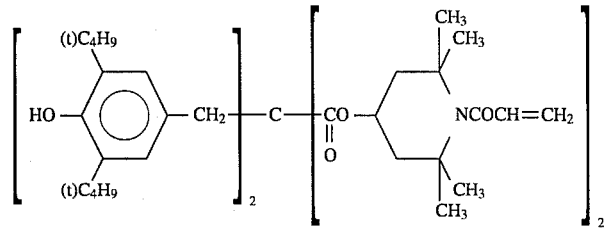
Cpd-14
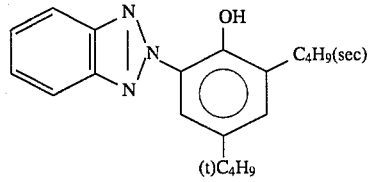
Cpd-15

-continued
Cpd-16
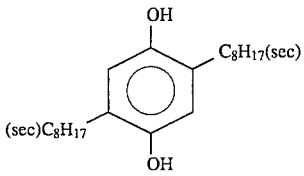
Polyethyl Acrylate (MW = 10,000 ~ 100,000) Cpd-8
Cpd-9
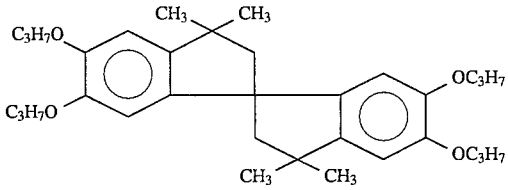
Cpd-10
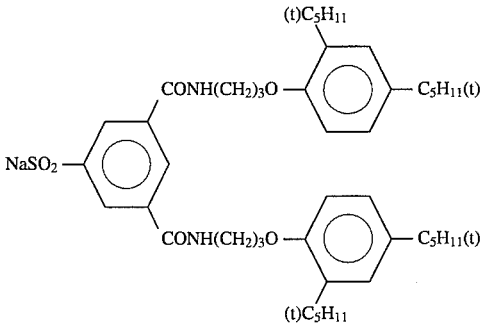
Cpd-11
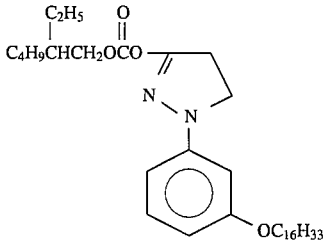
Cpd-3
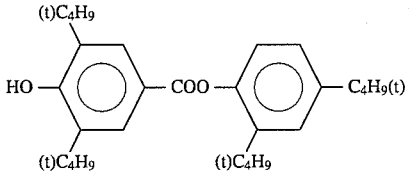
Cpd-4
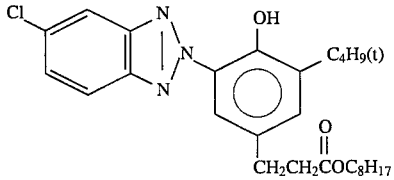
Cpd-5
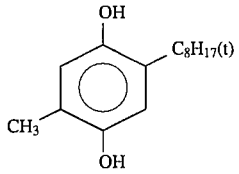
Cpd-6
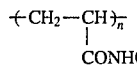
(n = 100 ~ 100)

-continued

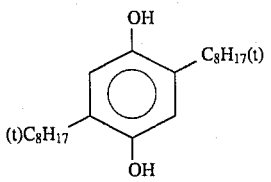

Cpd-7

Further, samples were prepared in the same manner as in the preparation of Sample No. 401 except that the same sensitizing dyes as those used for the preparation of other samples in Example 3 were used in place of Sensitizing Dye ExS-1. The samples were exposed to white light through a wedge, and processed in the following stages. Evaluation was made in the same manner as in Examples 2 and 3.

Similar effects to those obtained in Examples 2 and 3 were obtained. The processing stage and the compositions of processing solutions was as follows:

| Processing Stage: | | |
|---|---|---|
| First Development (Black and White Development) | 38° C. | 75 sec |
| Rinsing | 38° C. | 90 sec |
| Reversal Exposure | 100 lux or more | 60 sec or more |
| Color Development | 38° C. | 135 sec |
| Rinsing | 38° C. | 45 sec |
| Bleaching-Fixing | 38° C. | 120 sec |
| Rinsing | 38° C. | 135 sec |
| Drying | 60° C. | 1 min |

Compositions of Processing Solutions:

| First Developing Solution: | |
|---|---|
| Pentasodium Nitrilo-N,N,N-trimethylene-phosphonate | 0.6 g |
| Pentasodium Diethylenetriamine-pentaacetate | 4.0 g |
| Potassium Sulfite | 30.0 g |
| Potassium Thiocyanate | 1.2 g |
| Potassium Carbonate | 35.0 g |
| Potassium Hydroquinonemonosulfonate | 25.0 g |
| Diethylene Glycol | 15.0 ml |
| 1-Phenyl-4-hydromethyl-4-methyl-3-pyrazolidone | 2.0 g |
| Potassium Bromide | 0.5 g |
| Potassium Iodide | 5.0 mg |
| Water to make | 1 l (pH9.70) |

| Color Developing Solution: | |
|---|---|
| Benzyl Alcohol | 15.0 ml |
| Diethylene Glycol | 12.0 ml |
| 2,6-Dithia-1,8-octanediol | 0.2 g |
| Pentasodium Nitrilo-N,N,N-trimethylene-phosphonate | 0.5 g |
| Pentasodium Diethylenetriaminepenta-acetate | 2.0 g |
| Sodium Sulfite | 2.0 g |
| Potassium Carbonate | 25.0 g |
| Hydroxylamine Sulfate | 3.0 g |
| N-Ethyl-N-(β-methanesulfonamidoethyl)-3-methyl-4-aminoaniline Sulfate | 5.0 g |
| Potassium Bromide | 0.5 g |
| Potassium Iodide | 1.0 mg |
| Water to make | 1 l (pH10.40) |

| Bleaching-Fixing Solution: | |
|---|---|
| 2-Mercapto-1,3,4-triazole | 1.0 g |
| Disodium Ethylenediaminetetraacetate Dihydrate | 5.0 g |
| Ammonium Ethylenediaminetetraacetato Ferrate Monohydrate | 80.0 g |
| Sodium Sulfite | 15.0 g |
| Sodium Thiosulfate (700 g/liter) | 100.0 ml |
| Glacial Acetic Acid | 5.0 ml |
| Water to make | 1 l (pH6.50) |

It will be understood from the above disclosure that according to the present invention there can be obtained an effect of increasing green sensitivity and an effect of preventing the sensitivity of the photographic materials during storage from being lowered.

What is claimed is:

1. A silver halide photographic material comprising a support and having thereon at least one silver halide photographic emulsion layer and containing at least one compound represented by the following formula (I):

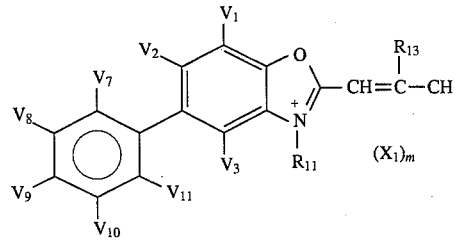

wherein $R_{11}$ and $R_{12}$ are the same or different and each represents an alkyl group;

$R_{13}$ represents a hydrogen atom, an alkyl group or an aryl group;

$V_1$, $V_2$, $V_3$, $V_4$, $V_5$, $V_6$, $V_8$, $V_9$, $V_{10}$, $V_{11}$ and $W_{01}$ are the same or different and each represents a hydrogen atom, an alkyl group having from 1 to 5 carbon atoms, an alkoxy group having from 1 to 5 carbon atoms, an aryloxy group having from 6 to 10 carbon atoms, a halogen atom or a trifluoromethyl group;

$V_7$ represents an alkyl group having from 1 to 5 carbon atoms, an alkoxy group having from 1 to 5 carbon atoms, an aryloxy group having from 6 to 10 carbon atoms, a halogen atom or a trifluoromethyl group;

$X_1$ represents a charge-neutralizing counter ion; and m represents a number of 0 or more necessary for neutralizing the molecular charge.

2. The silver halide photographic material as claimed in claim 1, wherein the compound is represented by the following formula (III):

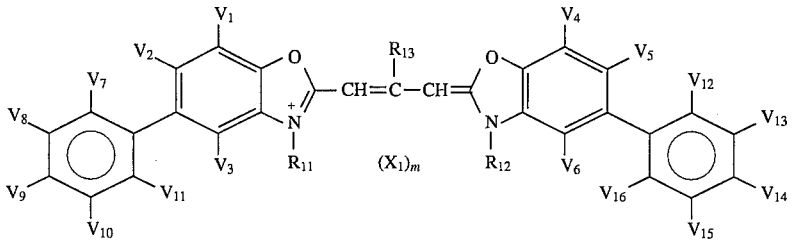

(III)

wherein $R_{11}$ and $R_{12}$ are the same or different and each represents an alkyl group;

$R_{13}$ represents a hydrogen atom, an alkyl group or an aryl group;

$V_1$, $V_2$, $V_3$, $V_4$, $V_5$, $V_6$, $V_8$, $V_9$, $V_{10}$, $V_{11}$, $V_{12}$, $V_{13}$, $V_{14}$, $V_{15}$ and $V_{16}$ are the same or different and each represents a hydrogen atom, an alkyl group having from 1 to 5 carbon atoms, an alkoxy group having from 1 to 5 carbon atoms, an aryloxy group having from 6 to 10 carbon atoms, a trifluoromethyl group or a halogen atom;

$V_7$ represents an alkyl group having from 1 to 5 carbon atoms, an alkoxy group having from 1 to 5 carbon atoms, an aryloxy group having from 6 to 10 carbon atoms, a halogen atom or a trifluoromethyl group;

$X_1$ represents a charge-neutralizing counter ion; and m represents a number of 0 or more necessary for neutralizing the molecular charge.

3. The silver halide photographic material as claimed in claim 1, wherein $R_{11}$ and $R_{12}$ are each selected from the group consisting of a sulfoethyl group, a sulfopropyl group, a sulfobutyl group, a carboxymethyl group and a carboxyethyl group.

4. The silver halide photographic material as claimed in claim 1, wherein $R_{13}$ is selected from the group consisting of a methyl group, an ethyl group and a propyl group.

5. The silver halide photographic material as claimed in claim 1, wherein $V_1$, $V_2$, $V_3$, $V_4$, $V_5$, $V_6$, $V_8$, $V_9$, $V_{10}$ and $V_{11}$ are each selected from the group consisting of a hydrogen atom, a methyl group, an ethyl group, a propyl group, a methoxy group, an ethoxy group, a phenoxy group, a chlorine atom and a trifluoromethyl group; and $V_7$ is selected from the group consisting of a methyl group, an ethyl group, a propyl group, a methoxy group, an ethoxy group, a phenoxy group, a chlorine atom and a trifluoromethyl group.

6. The silver halide photographic material as claimed in claim 1, wherein $V_1$, $V_2$, $V_3$, $V_4$, $V_5$ and $V_6$ are each a hydrogen atom.

7. The silver halide photographic material as claimed in claim 2, wherein $R_{11}$ and $R_{12}$ are each selected from the group consisting of a sulfoethyl group, a sulfopropyl group, a sulfobutyl group, a carboxymethyl group and a carboxyethyl group.

8. The silver halide photographic material as claimed in claim 2, wherein $R_{13}$ is selected from the group consisting of a methyl group, an ethyl group and a propyl group.

9. The silver halide photographic material as claimed in claim 2, wherein $V_1$, $V_2$, $V_3$, $V_4$, $V_5$, $V_6$, $V_8$, $V_9$, $V_{10}$, $V_{11}$, $V_{12}$, $V_{13}$, $V_{14}$, $V_{15}$ and $V_{16}$ are each selected from the group consisting of a hydrogen atom, a methyl group, an ethyl group, a propyl group, a methoxy group, an ethoxy group, a phenoxy group, a chlorine atom and a trifluoromethyl group; and $V_7$ is selected from the group consisting of a methyl group, an ethyl group, a propyl group, a methoxy group, an ethoxy group, a phenoxy group, a chlorine atom and a trifluoromethyl group.

10. The silver halide photographic material as claimed in claim 2, wherein $V_1$, $V_2$, $V_3$, $V_4$, $V_5$ and $V_6$ are each a hydrogen atom.

11. The silver halide photographic material as claimed in claim 1, wherein the compound represented by formula (I) is used in an amount of from $4\times10^{-6}$ to $8\times10^{-3}$ per mole of silver halide.

12. A silver halide photographic material comprising a support having thereon at least one silver halide photographic emulsion layer and containing at least one compound represented by the following formula (II):

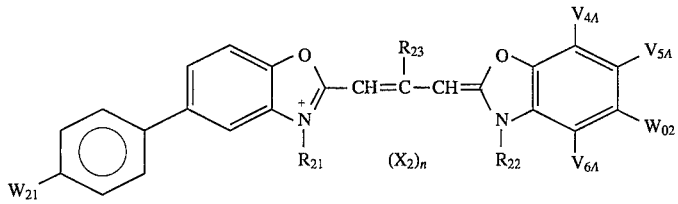

(II)

wherein $R_{21}$ and $R_{22}$ are the same or different and each represents an alkyl group;

$R_{23}$ represents a hydrogen atom, an alkyl group or an aryl group;

$V_{4A}$, $V_{5A}$, and $V_{6A}$ are the same or different and each represents a hydrogen atom, an alkyl group having from 1 to 5 carbon atoms, an alkoxy group having from 1 to 5 carbon atoms, an aryloxy group having from 6 to 10 carbon atoms or a halogen atom;

$W_{02}$ represents a hydrogen atom, an alkyl group having from 1 to 7 carbon atoms, an alkoxy group having from 1 to 10 carbon atoms, an aryloxy group having from 6 to 10 carbon atoms, or a halogen atom;

$W_{21}$ represents an alkyl group having from 2 to 7 carbon atoms, an alkoxy group having from 2 to 10 carbon atoms or an aryloxy group having from 6 to 10 carbon atoms;

$X_2$ represents a charge-neutralizing counter ion; and n represents a number of 0 or more necessary for neutralizing the molecular charge.

13. The silver halide photographic material as claimed in claim 12, wherein the compound is represented by the following formula (IV):

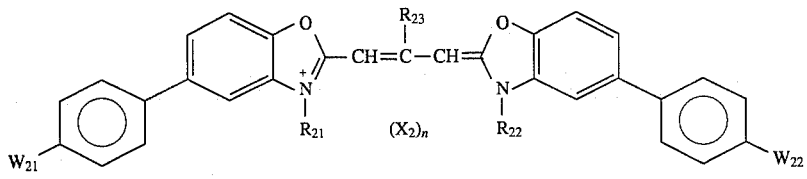

(IV)

wherein $R_{21}$ and $R_{22}$ are the same or different and each represents an alkyl group;

$R_{23}$ represents a hydrogen atom, an alkyl group or an aryl group;

$W_{21}$ and $W_{22}$ are the same or different and each represents an alkyl group having from 2 to 7 carbon atoms, an alkoxy group having from 2 to 10 carbon atoms, or an aryloxy group having from 6 to 10 carbon atoms;

$X_2$ represents a charge-neutralizing counter ion; and n represents a number of 0 or more necessary for neutralizing the molecular charge.

14. The silver halide photographic material as claimed in claim 12, wherein $W_{21}$ is selected from the group consisting of a propyl group, a t-butyl group, an ethoxy group, an n-butyl group and a phenoxy group.

15. The silver halide photographic material as claimed in claim 12, wherein $R_{23}$ is selected from the group consisting of a methyl group, an ethyl group and a propyl group.

16. The silver halide photographic material as claimed in claim 12, wherein $R_{21}$ and $R_{22}$ are each selected from the group consisting of a sulfoethyl group, a sulfopropyl group, a sulfobutyl group, a carboxymethyl group and a carboxyethyl group.

17. The silver halide photographic material as claimed in claim 12, wherein $V_{4A}$, $V_{5A}$ and $V_{6A}$ are each a hydrogen atom.

18. The silver halide photographic material as claimed in claim 12, wherein the compound represented by formula (II) is used in an amount of from $4\times10^{-6}$ to $8\times10^{-3}$ per mole of silver halide.

* * * * *